United States Patent [19]

Peters, Jr.

[11] 4,266,214

[45] May 5, 1981

[54] ELECTRONICALLY OPERABLE GAME SCORING APPARATUS

[76] Inventor: Joseph Peters, Jr., 2509 Q. 179th St., Torrance, Calif. 90504

[21] Appl. No.: 78,230

[22] Filed: Sep. 24, 1979

[51] Int. Cl.[3] ..... G06F 15/44; G08B 5/36

[52] U.S. Cl. ..... 340/323 R; 235/92 GA; 364/410

[58] Field of Search ..... 340/323; 235/92 GA; 364/410, 411; 273/32 B

[56] References Cited

U.S. PATENT DOCUMENTS

| | | | |
|---|---|---|---|
| 3,959,640 | 5/1976 | Syria | 340/323 R |
| 4,097,855 | 6/1978 | Salvo | 340/323 R |
| 4,130,871 | 12/1978 | Olsen et al. | 235/92 GA |

*Primary Examiner*—Donald J. Yusko

*Attorney, Agent, or Firm*—Romney, Schaap, Golant, Disner & Ashen

[57] ABSTRACT

An electronically operated game scoring apparatus in the form of a relatively small hand-held portable housing. The housing is provided with a plurality of manually actuable input keys for introducing scoring information relative to a game. The housing includes an electrical circuit means and preferably a microprocessor for generating scoring information about the game or one or more players of the game. The housing is provided with a plurality of manually operable display controlling switches which provide for the display of scoring information regarding the game or the players and scoring information regarding a total score of the game or of an event in the game. In a preferred embodiment, a plurality of display members are included on the housing for substantially simultaneously displaying scoring information about different aspects of the game.

54 Claims, 7 Drawing Figures

DATA STORAGE FORMAT

| | C1 | C2 | C3 | C4 | C5 | C6 | C7 |
|---|---|---|---|---|---|---|---|
| R1 | | | | | | | |
| R2 | | | | | | | |
| R3 | | | | | | | |
| R4 | | | | | | | |
| R5 | | | | | | | |
| R6 | | | | | | | |
| R7 | | | | | | | |
| R8 | | | | | | | |
| R9 | | | | | | | |
| R10 | | | | | | | |
| R11 | | | | | | | |
| R12 | | | | | | | |
| R13 | | | | | | | |
| R14 | | | | | | | |
| R15 | | | | | | | |
| R16 | | | | | | | |
| R17 | | | | | | | |
| R18 | | | | | | | |
| R19 | | | | | | | |
| R20 | | | | | | | |
| R21 | | | | | | | |
| R22 | | | | | | | |

FIG. 7

ELECTRONICALLY OPERABLE GAME SCORING APPARATUS

BACKGROUND OF THE INVENTION

1. Field of the Invention

This invention relates in general to certain new and unusual improvements in scoring apparatus for games, and more particularly, to an electronically operable scoring apparatus which is capable of providing scoring information about a game and scoring information about the players of the game.

2. Brief Description of the Prior Art

Various game forms, including athletic events, card games, various board games, and the like, are an important aspect of recreational activity for many people. In many games, one or more events or rounds are required in the course of the game and usually one or more players compete with respect to each of these rounds or events. In this way, each player of the game has an opportunity to score points in each round or event, and the number of events which are included in a game can, of course, be fixed or variable. Generally, the winner of the game is determined by accumulating the individual scores for each event and for each player into a total score.

Accurate recording of the scores for each round of the game and for the entire game is always desirable, and in many cases, even mandatory. Poor scorekeeping often leads to dissatisfied players and thus defeats the recreational value of the game. Inasmuch as there are usually several events in a game and several scores generated for each player, it is usually necessary to record the scores of various elements leading to scores inasmuch as there are too many variables to be remembered. The typical method of scorekeeping involves the writing of the appropriate numbers of other scorekeeping indicia on a piece of paper or a pre-printed scorecard designed for a particular game. The total scores of the game and for each player are typically calculated manually.

There are several problems in manual scorekeeping techniques, that is, by writing the scores on a piece of paper or scorepad. The legibility of the scorekeeper's penmanship, to be sure, is an important factor inasmuch as the recorder must write clearly enough for all players to be able to read their scores for each event. In addition, there is always a possibility of human error in calculating, since the scores are accumulated manually, and this oftentimes requires someone to proof the scorekeeper's calculations. In any event, the game may be delayed while scores are being calculated, inasmuch as it is oftentimes necessary for a particular player to know his score at any particular point during the game. This may be particularly true in athletic games, such as golf.

One of the important problems in manual scorekeeping techniques is that the rules of the game may be circumvented or modified, either deliberately or through ignorance. This oftentimes gives rise to disputes and maybe even the necessity of referring to an official rule book if one is available, thereby again creating a delay in the game. One of the principal difficulties in manual scorekeeping is the lack of a suitable writing surface, typically in many athletic events, again, such as the game of golf. Moreover, the lack of a suitable writing instrument oftentimes creates a problem, as for example, a broken pencil point or a soiled scorecard inhibiting the writing of the score. All of these difficulties of manual scorekeeping reduce the full satisfaction which could otherwise be obtained from the game.

To date, there has been no effective special function calculator which has been designed to provide scoring information for games such as athletic games, board games, and other forms of games. It becomes apparent that the ability of a special function electronic games scoring apparatus would be advantageous in easing the burden of keeping score and thus rendering less burden and more enjoyment to the play of the game.

In recent years, there have been many significant advances in electronic calculators of the type which are designed to solve general mathematical computational problems. Generally, there are two basic types of calculators which are commercially available. The first type of calculator is the typical four function calculator which is capable of solving basic mathematical problems, such as addition, subtraction, multiplication and division. These calculators have found a widespread use among a large segment of the population for both business and personal use. A second type of calculator has been designed for the more technologically oriented user, as for example, the scientific user. This latter form of calculator has been designed in a variety of forms to solve specific technological problems.

To date, there have only been a few effective special function calculators which have been designed to provide electronic calculating capabilities for specific end uses. One form of special function has been designed to solve accounting problems. Consequently, there has been a wide acceptance of this latter type of special function calculator by those parties working in the accounting field or in areas relating to the accounting field. Another form of special function calculator has been designed to provide aircraft navigational information.

OBJECTS OF THE INVENTION

It is, therefore, a primary object of the present invention to provide an electronically operable game scoring apparatus which is portable and hand-held and capable of being manually actuable by players of the game to calculate and provide scoring information about the game and about one or more of the players of the game.

It is another object of the present invention to provide an electronically operable game scoring apparatus of the type stated, which may include a plurality of individual and substantially simultaneously operable display members for substantially simultaneously displaying different types of scoring information.

It is a further object of the present invention to provide a game scoring apparatus of the type stated which can be constructed with commercially available microprocessors requiring only a mask type programming in order to accomplish the intended results.

It is an additional object of the present invention to provide an electronically operable game scoring apparatus which is capable of calculating and storing individual scores for multiple players, calculating and storing scores for each player for several rounds or events, parameters for each round or event and for the entire game, calculating and displaying scores for each round and for the game and for each player and displaying all such required score information.

It is another salient object of the present invention to provide an apparatus of the type stated which is compact, light in weight and ruggedly constructed so as to be able to withstand rough handling and abuse of the type normally encountered in various athletic type activities.

It is still another object of the present invention to provide an apparatus of the type stated which is conveniently adapted to accept auxilliary components, as for example, data information input devices and printer devices, and the like.

It is still a further object of the present invention to provide a method of electronically storing and calculating and displaying scoring information for a game and for one or more players of the game on an electronically operable game scoring apparatus.

It is yet another object of the present invention to provide an easy and convenient method for introducing all of the required data regarding the score for each of the particular players of the game and to present various playing parameters for the game and for the events in the game.

With the above and other objects in view, my invention resides in the novel features of form, construction, arrangement and combination of parts presently described and pointed out in the claims.

BRIEF SUMMARY OF THE DISCLOSURE

An electronically operable scoring apparatus, preferably in the nature of a small portable hand-held housing, which contains all of the necessary input and output functions thereon. The scoring apparatus of the invention is adaptable to be implemented for a wide variety of games, including, but not limited to, athletic games such as golf, tennis, pool, billiards, football, baseball, basketball, etc. In addition, the game scoring apparatus can be used with a variety of card games such as bridge, canasta, gin rummy, and other forms of known card games. The scoring apparatus is also adaptable for scoring with various board games, as for example, scrabble, dominoes, etc. In essence, the electronically operable game scoring apparatus of the invention is adaptable for use in essentially any type of game activity in which games are comprised of one or more events or rounds where scores are or can be generated.

The game apparatus of the present invention can be constructed so that it is adapted for providing scoring functions for a number of games without any external programming required. For example, the game apparatus of the invention could be constructed so as to provide a multiple function keyboard to enable calculation and display of scoring information for games such as baseball, and also games such as football or golf on a single apparatus.

The game apparatus of the present invention is provided with a first set of manually actuable input switches or so-called "keys" which are capable of introducing data, typically numeric data, into the apparatus, and particularly into a storage member in the apparatus. A microprocessor or other memory in the apparatus would be suitably programmed in order to receive the introduced information and process this information in accordance with the rules of a game in which scores are to be calculated and presented. Thus, for example, the microprocessor or other memory in the apparatus could be suitably programmed in order to receive and calculate introduced data with respect to a game of golf. In this way, the apparatus could provide certain output information, as for example, the scores of each of the players and the total score of the game, the handicap for each of the players, the par value for a particular hole, and like information. With respect to certain information of the game, as for example, par information and handicap information, the apparatus can be suitably adapted to enter this information.

In one of the preferred embodiments of the invention, the apparatus can be provided with a plurality of display devices which may be substantially simultaneously operated for displaying different types of scoring information. Thus, for example, in the case of the apparatus being adapted for a game of golf, the apparatus could simultaneously display scoring information for several players, e.g., three or four players, or more. The apparatus could also simultaneously display certain information about the game or the course of the game. For example, the apparatus could display the hole of the game and the par for that hole game. It could also display the number of yards for a particular hole and a particular handicap rate. In like manner, individual manually actuable display operable switches could be provided for initiating any of these display devices.

The apparatus of the invention could also be adapted for use as a conventional calculator. For example, the same keyboard which is used for introducing scoring data can also be used to introduce information for calculations. A separate function keyboard would be provided to enable the apparatus to perform various calculations such as additions, subtractions, etc.

The game apparatus would be normally provided with a means for displaying the information but also retaining the information which has been displayed for later use. In like manner, the apparatus would be provided with a clear switch in order to clear information and a reset switch in order to reset any particular form of data. In like manner, the display format would be easy to read and also constructed with respect to the nature of the game. The apparatus could also be adapted to operate on an external source of power, such as AC source of power, or a portable source of power, such as batteries, or the like.

The apparatus may also be adapted for receiving input data as for example, by a pre-coded magnetic card. In this way, various cards could be pre-established for certain aspects of a game and for certain plays of a game. For example, in the game of golf, a pre-recorded magnetic card containing data about the number of holes, the par for each hole, the handicaps, and the like, could be introduced into a sensing member capable of reading a magnetic card or other source of introduced data. In like manner, the apparatus of the invention may be adapted for a printer so as to enable printing of hard copy. In this way, the apparatus can provide a hard copy record including dates, names, etc. for each of the players. An auxiliary printer could be connected to the apparatus for this purpose. Moreover, the apparatus could be constructed with a printing matrix circuit for adaption to a conventional printer device.

This invention possesses many other advantages and has other purposes which may be made more clearly apparent from a consideration of the forms in which it may be embodied. These forms are shown in the drawings forming and accompanying part of the present specification. They will now be described in detail for the purposes of illustrating the general principals of the invention, but it is to be understood that such detailed descriptions are not to be taken in a limiting sense.

BRIEF DESCRIPTION OF THE DRAWINGS

Figure 1:
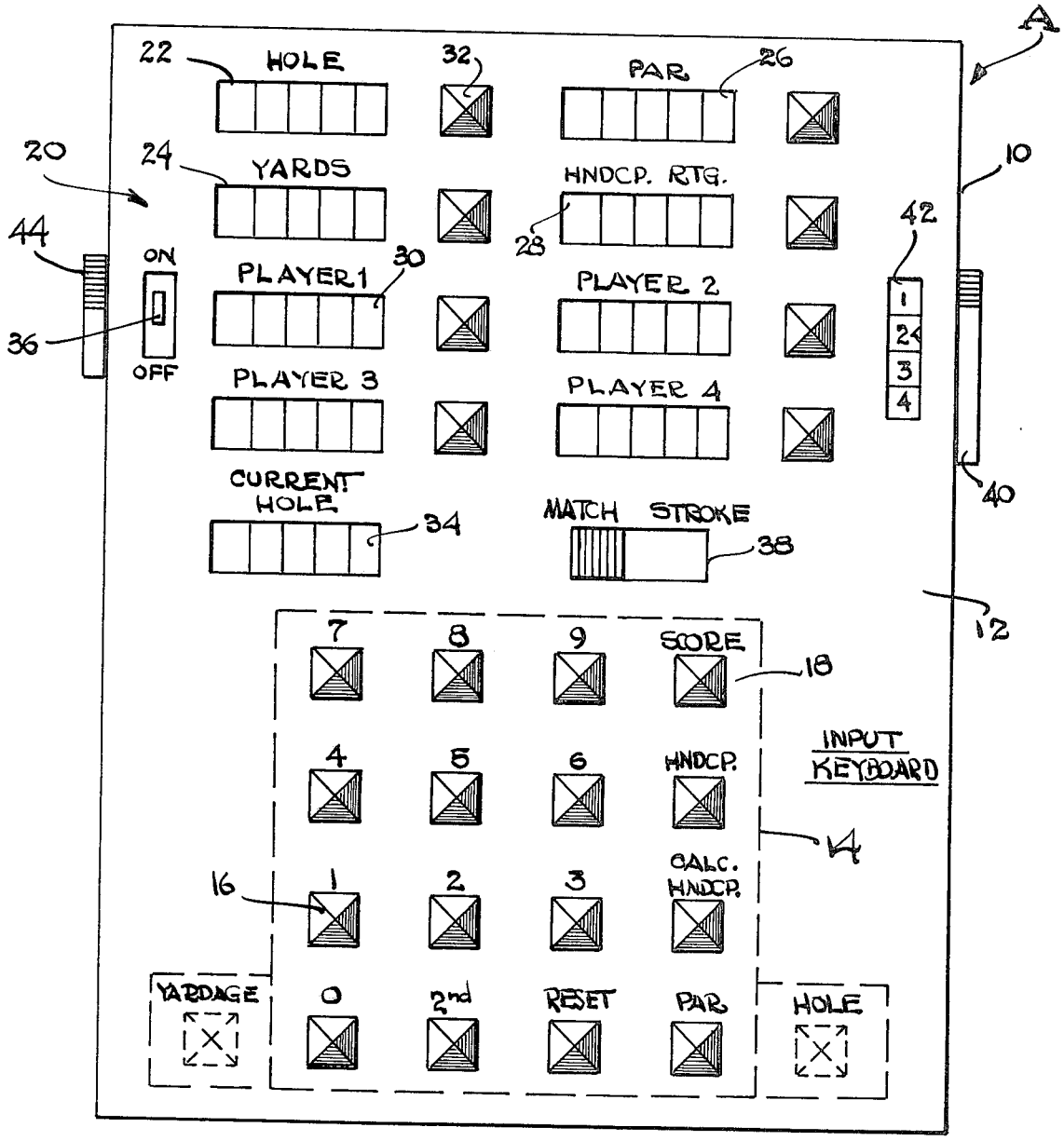
Figure 5:
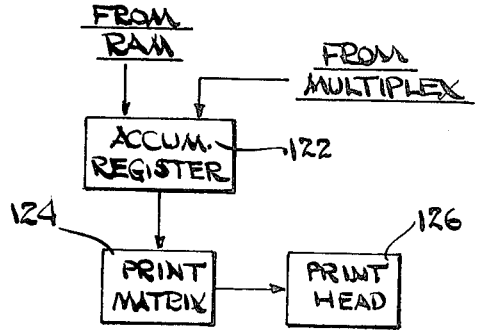
Figure 2:
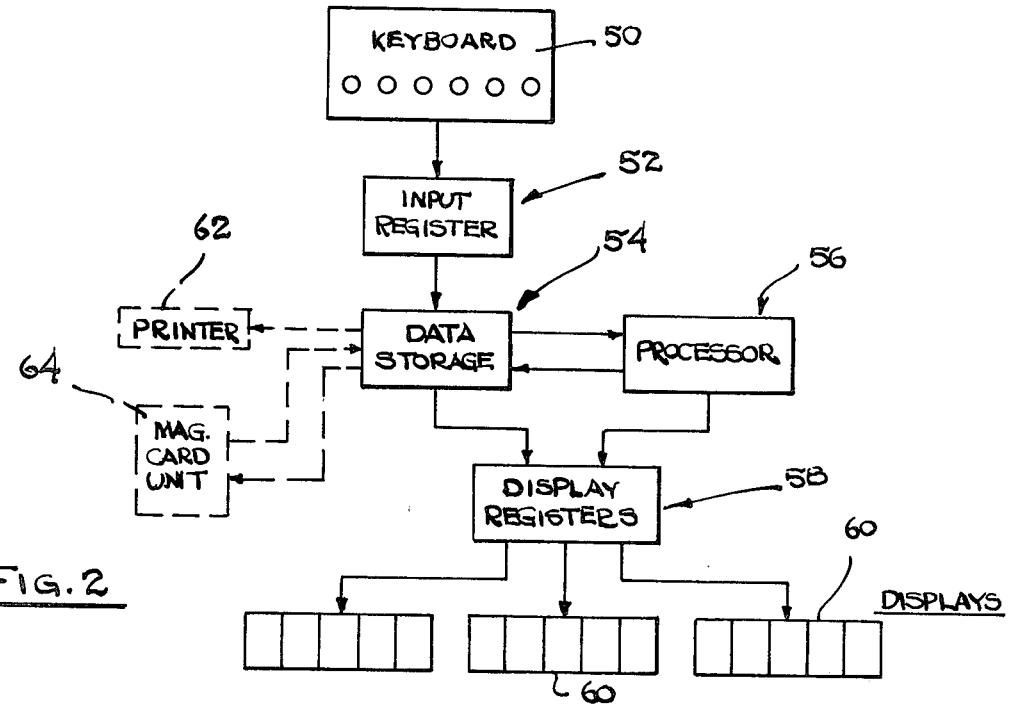
Figure 6:
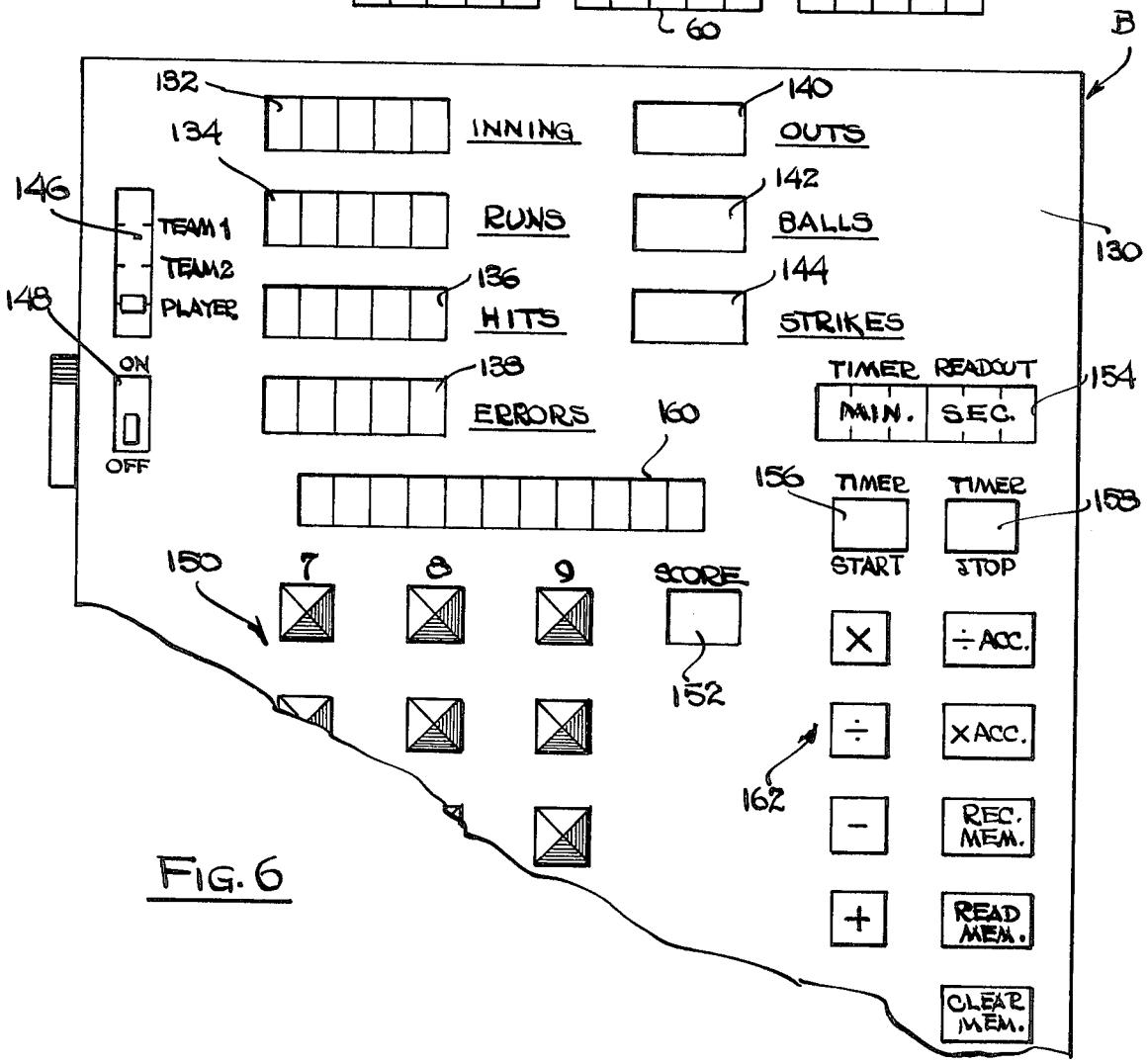
Figure 3:
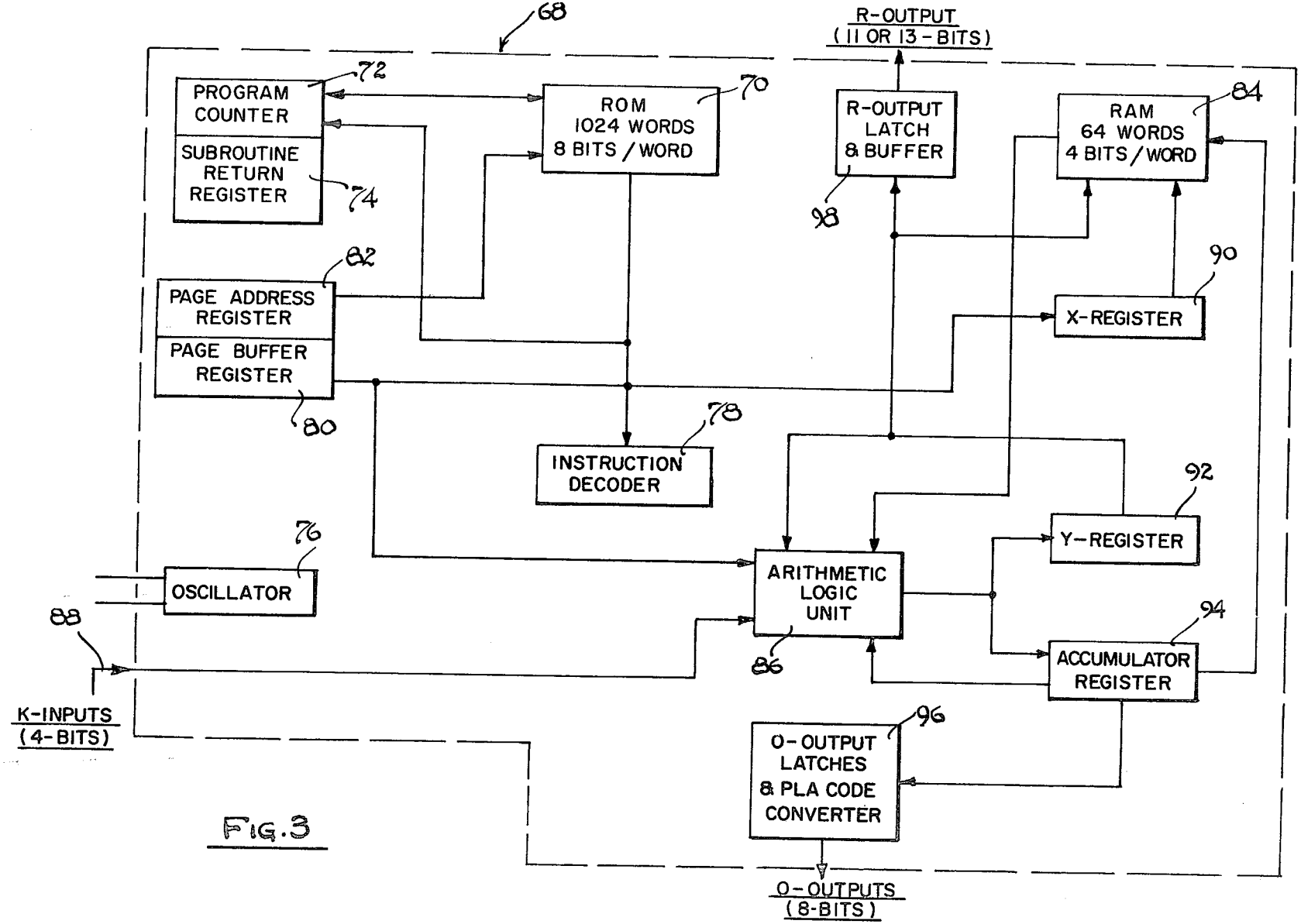
Figure 4:
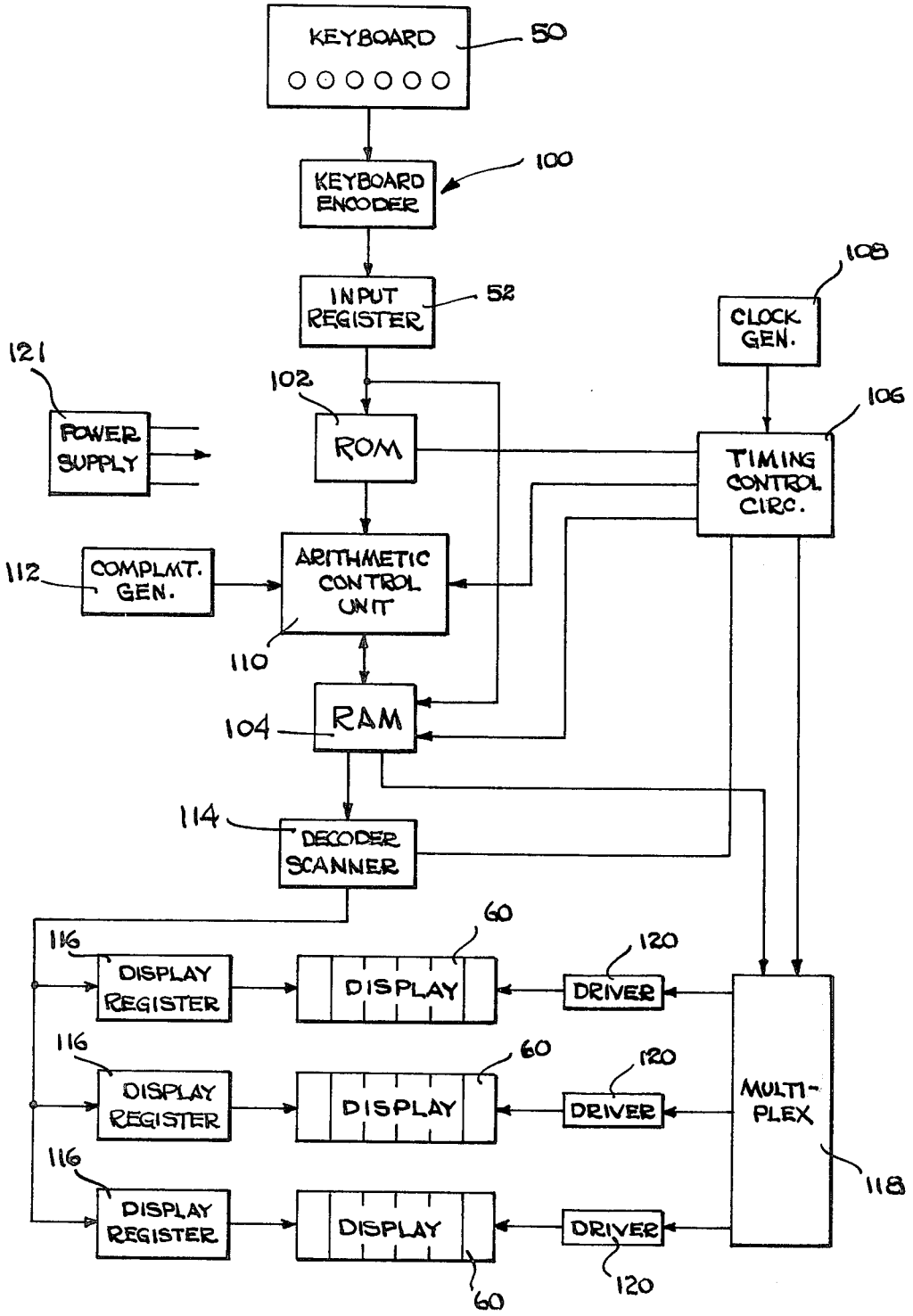

Having thus described the invention in general terms, reference will now be made to the accompanying drawings in which:

FIG. 1 is a top plan view of a keyboard forming part of an electronically operable game scoring apparatus constructed in accordance with and embodying the present invention;

FIG. 2 is a schematic circuit view showing a generalized form of circuit which may be used with the apparatus of the present invention;

FIG. 3 is a schematic view of one form of microprocessor which may be used in the apparatus of the present invention;

FIG. 4 is a more detailed schematic circuit view showing many of the components forming part of the electronic circuit in the apparatus of the invention;

FIG. 5 is a schematic circuit view showing additional components which may be included in the apparatus for a connection to a conventional printer;

FIG. 6 is a plan view of another form of keyboard which may be used in the electronically operable game scoring apparatus of the present invention; and FIG. 7 is a schematic view of a memory arrangement for storing introduced data and calculated scoring information.

BRIEF DESCRIPTION OF PREFERRED EMBODIMENTS

Referring now in more detail and by reference characters to the drawings which illustrate practical embodiments of the present invention, A designates an electronically operable game scoring apparatus comprising an outer housing 10 and having a face plate 12 thereon. The housing and the face plate could be suitably constructed of various plastics such as polyethylene, polystyrene, polybutadiene, etc. Otherwise, the housing and face plate could be formed of various metals, such as aluminum or other nonmetals. The housing itself is not a unique part of the present invention but merely holds the face plate and various other components forming part of the apparatus therein. Accordingly, the housing itself is neither illustrated nor described in any further detail herein.

As indicated previously, the game apparatus of the present invention can be adapted for use with a wide variety of games. However, in order to more fully illustrate the principal and construction of a game apparatus of the present invention, the game apparatus say will be described in the embodiment where it is adapted for use in the game of golf.

The face plate 12 is provided with an input keyboard 14 for introducing data pertinent to scoring in the game apparatus A. The keyboard 14 is provided with ten manually operable numeric data input keyboard switches, or so-called "keys" 16 which are designated "1" through "9" and "0" for introducing input data. In addition, the input keyboard 14 is provided with certain input function switches designated as 18, and include at least the following switches or keys:

1. A "score" switch which enables the calculation or determination of a score for a particular round or event, as for example, a hole in a game of golf;

2. A "handicap" switch, designated as "HNDCP" for introducing particular handicap data for a player;

3. A "calculate handicap" switch, designated as "CALC HNDCP", which is designated to cause the apparatus to calculate a particular handicap;

4. A "reset" switch for clearing or resetting the apparatus;

5. An "upper case" switch, designated as "2nd" for causing two functions to be performed simultaneously or in sequence by actuation of a single key;

The keyboard also may include the following switches associated with displays to operate as display controlling switches; but which are nevertheless function switches as such:

6. A "par" switch for placing the apparatus into a mode where it is capable of receiving introduced par data or otherwise where it is capable of calculating and presenting par information.

7. A "hole" switch for placing the apparatus into a mode where it is capable or receiving introduced hole data or otherwise where it is capable of calculating and presenting hole information. (In this case, the "hole" data or information may be equivalent to data or information with respect to an "event" in another game);

8. A "yardage" switch designated as "Yardage" for placing the apparatus into a mode where it is capable of receiving yardage data or otherwise where it is capable of calculating and presenting yardage information. (In this case, the yardage information and data is used for the game of golf and may be equivalent to data or information representing distance for another game.

9. A "Handicap Rating" switch which could be designated as "HNDCP RTG" for placing the apparatus into a mode where it is capable of receiving handicap rating data.

10. Four "player" switches, which could be designated as "Player 1" thru "Player 4" for placing the apparatus into a mode where it is capable of receiving data related to any specific player.

It should be understood that other forms of input function switches or other switches for introducing data could be provided on the apparatus in accordance with the present invention. Some additional function switches which would not operate as display controlling switches could be provided; e.g., an additional yardage switch and an additional hole switch, as shown in dotted lines in FIG. 1. Some of the function switches could be operated in combination with other function switches or in combination with the data input switches in certain sequences to cause certain functions of the apparatus to be initiated. Some of the other function switches which could be included on the apparatus, however, (not shown) are:

1. An "auxilliary print" switch for initiating a printing operation as hereinafter described in more detail;

2. An "auxilliary data input" switch for enabling an auxilliary data input device to be coupled to the apparatus and to operate same;

3. An "auxilliary data output" switch for enabling certain information in the apparatus to be transferred to another storage member for further use and which other storage member may be temporarily interfaced to the apparatus of the present invention.

The above-described additional function switches are only exemplary of some of the function switches which could be included on the apparatus. Further, the data input switches are described as being numeric. However, it should be understood that other forms of keyboards, including alph-numeric keyboards and the like, could be provided.

The apparatus of the present invention has been described in terms of calculating output information. In this respect, it should be understood that a true mathematical calculation may not be necessary and that only a simple determination may be required. Thus, the term calculate shall be deemed to include determination in the present invention.

The face plate is also provided with a plurality of individual display devices 20 for displaying various scoring information relevant to the game, as for example, in this case the game of golf.

In the illustrated apparatus of the invention, the first display device 22 is provided for displaying information regarding a particular hole. A second display device 24 is provided for displaying information regarding yards that is, the number of yards in which a ball may have been hit or otherwise, the number of yards for a particular hole. A third display member 26 is provided for visually presenting par information regarding a particular hole and a display member 28 is provided for presenting handicap information regarding a particular aspect of the game or a particular player. Finally, four player display devices for players 1 through 4 are provided. These player display devices 30 are designed to provide display information regarding any one of the particular players as opposed to information regarding the game per se.

Each of the aforementioned display devices are operable by individual display operable switches 32. In this case, the user merely actuates the switch 32 by pressing the same in order to permit operation of that particular display device. The face plate of the apparatus is also provided with a current hole display device 34 which is provided to display information regarding a current hole of the play.

Each of the display devices are preferably multi-segment display devices, that is, they may be comprised of a plurality of individual display elements. Notwithstanding, the plurality of display elements of each particular display device only constitutes one display device.

The face plate 12 may be also provided with additional control switches, as for example, an off-on switch 36, a switch 38 to designate either match or stroke information and an additional dial type switch 40 along with an indicator 42 designed to select information for any one of the particular players which may appear in the player displays or additional displays which may be provided (not shown). In addition, a rotatable multi-position switch 44 could be provided as an off-on switch in place of the switch 36, or for other purposes.

FIG. 2 schematically represents some of the major components forming part of the apparatus of the present invention. Thus, by reference to FIG. 2, 50 represents a keyboard generally comprising each of the manually operable push button keys on the face plate 12 and further including all of the other function and input data switches and display switches thereon. The keyboard would be provided with a proper keyboard encoding means, hereinafter described in more detail.

The apparatus of the invention, also in its simplified terms, including an input register means 52 which would actually constitute one or more registers, as for example, shift registers. In addition, these registers may adopt the form of certain types of memory units. The input registers are generally designed to hold input data, much in the manner of a buffer storage, for later use in processing the same.

The apparatus also includes in the simplified format a data storage means 54 along with a processing means 56. The data storage means may again adopt any form of conventional data storage which is commercially available. The same holds true of the processor means 56 in that any of a number of known microprocessors may be operable with the data storage 54 in order to process the data and display the calculated information in a manner as hereinafter described in more detail. One such processor is also hereinafter described in more detail. For that matter, the processor 56 and the data storage means 54 may be part of the same integrated circuit chip.

The apparatus of the invention, also in its simplified terms, includes a display register means having one or more display registers 58. In this case, the display registers are designed to hold and permit generation of electrical signals to one or more display devices 60 so as to display results as calculated by the apparatus of the invention. Here again, three such displays are illustrated in FIG. 2 and would be comparable to the displays illustrated in FIG. 1. However, in FIG. 1, nine individual display devices are shown and therefore, it should be understood that FIG. 2 merely is presented in simplified schematic form, but in actuality, to adopt the embodiment of the invention as illustrated by the keyboard of FIG. 1, it would include nine individual display devices 60.

The display devices are typically shown as multi-segment display devices capable of generating a plurality of individual indicia simultaneously or substantially as for example, numeric indicia, or Arabic indicia. These displays constitute the primary technique for presenting data introduced into or information calculated by the apparatus of the invention. The displays would differ from a typical calculator display in that scores are employed in the preferred apparatus of the invention, and each of the individual displays serve different purposes. Thus, one display may present scoring information of the game, another display may present scoring information of a player, the third display may provide scoring information regarding a particular event, etc.

The data memory unit as indicated above, has a primary purpose of storing data for availability to the processing means and also to an arithmetic unit as hereinafter described in more detail. The data introduced into the apparatus of the invention will again be comprised of a multi-indicia code, that is, one comprised of a plurality of indicia, e.g., numeric indicia. Each indicia or digit or perhaps a group of the indicia or digits will be used to represent or reflect some aspect of the game for which the apparatus is used.

FIG. 2 also illustrates the possible use of a printer 62 which may be connected to the apparatus of the invention. In this case, the printer is illustrated as being connected to the data storage means 54, although it could be connected to the display registers or some other form of printer interface circuit, also hereinafter described in more detail. The printer 62 would be ideal in many embodiments of the invention to produce a hard copy of the results of the game. In this case, the printer 62 could either be integral with the apparatus of the invention or mounted thereon, or provided as a separate attachable and detachable unit with means to interface to the apparatus.

FIG. 2 also schematically illustrates in dotted lines, the possibility of an input device and perhaps output device 64 which may be designed for introducing data into the data storage 54 or for extracting information therefrom. Therefore, this device may be operable as an input and output device. In this case, a magnetic card unit has been illustrated as being connected to the data storage member. Here again, it could be connected to any other part of the apparatus of the invention as may be desired. The magnetic card unit would be effective for introducing data, e.g., certain scoring function information as for example, par information for certain golf course holes, handicap information or the like. This information could be conveniently produced in a magnetic card and merely inserted into a magnetic card reader for introduction of the information into the data storage member 54.

It should be understood that other forms of introducing and receiving output information could be substituted for the magnetic card unit. For example, a tape cassette device, or the like, could be used for introducing information and particularly scoring function information into the apparatus of the invention or for retrieving card calculated information. Here again, the input-output units as, for example, the magnetic card unit 64 could either be integral with the apparatus, mounted on the apparatus, or provided as a separate unit which is attachable and detachable from the apparatus.

As indicated previously, various forms of microprocessors could be available in the form of a single integrated circuit chip for use in the apparatus of the invention. For that purpose, the input register 52, the data storage 54, the processor 56 and the display registers 58 would all be included on a single circuit chip and would all form part of the "microprocessor". In many cases, the microprocessor itself could be separate from these units or include one or more of these units. Thus, the term "microcomputer" is used herein and is deemed to include at least the processor 56, the data storage 54, the input register 52 along with the display registers 58.

FIG. 3 illustrates one form of microcomputer which may be in the form of a single integrated circuit chip and which may be used in the present invention. The microcomputer is designated by reference numeral 68 and comprises a read-only memory, or so-called "ROM" 70 which may contain the storage for the program which is used. This program, of course, would be adapted to performed calculations with respect to a particular game, e.g., a game of golf. In the same respect, the apparatus of the invention could be adapted to contain a mode switch such that the apparatus could calculate information and provide scoring information for more than one game.

In one embodiment of the present invention, a microcomputer offered by Texas Instrument Company, and which exists in the form of a single integrated circuit chip designated by the trade name "TMS 1000" may be employed as the microcomputer. This particular microcircuit chip is a dedicated chip in which one layer thereof may be suitably programmed with proper program steps in order to perform the various functions of the game heretofore described. Thus, the one particular layer may be programmed in accordance with a program as hereinafter discussed. Thus, the program representative of this flow diagram is effectively introduced into the read-only memory 70.

The read-only memory 70 operates in conjunction with a program counter 72 and a sub-routine return register 74. The program counter 72 and the sub-routine register 74 are basically designed to keep track of the instructions introduced into the read-only memory 70. The program counter initiates an input to the read-only memory 70 and the sub-routine return register 74 may function as a part of the program counter 72. The sub-routine return register is actually used to implement the sub-routine calls in the program introduced into the read-only memory 70.

The microcomputer also is provided with a timing circuit 76, in the form of an oscillator, and which generates timing signals for all of the various components illustrated in the circuit chip forming the microcomputer 68. In this case, it should be understood that the various flow lines as illustrated in FIG. 3 actually show the movement of data and do not necessarily describe the actual interconnection of the various components. In this respect, it should be understood that the oscillator 76 would essentially be connected to practically all of the components as illustrated, in order to provide the proper timing signals thereto.

The microcomputer 68 also comprises an instruction decoder 78 which receives an output from the read-only memory 70 and implements specified sequences of connection between the various components forming part of the microcomputer 68. In this respect, the program counter 72 has an output which is connected to the read-only memory 70. Further, outputs of the read-only memory 70 are introduced into a page buffer register 80 which operates in conjunction with a page address register 82, and the latter of which has an input to the read-only memory 70. The page address register 82 and the buffer register 80 are designed to further address and access data which is in the read-only memory 70.

The microcomputer 68 further comprises a random access memory 84 which is used to store variable data quantities used in various operations and which are provided for execution of the program introduced into the read-only memory 70. In this respect, the read-only memory 70 is designed to store 1,024 eight-bit words, and the random access memory 84 is designed to store 64 four-bit words. The microcomputer 68 also comprises an arithmetic logic unit 86 which is designed to receive and operate on data introduced into the read-only memory 70 in accordance with the instructions which have been introduced into the read-only memory 70. The arithmetic logic unit 86 receives data from the read-only memory 70, and further, receives data from the random access memory 84 in the manner as illustrated. In addition, information may be introduced into the microcomputer 68 through an input 88 and which is also provided for introducing information into the arithmetic logic unit 86.

The random access memory 84 operates in conjunction with an X-register 90 and a Y-register 82. The X-register 90 and the Y-register 92 are designed to address locations in the random access memory 84 and to access the memory therein. In addition, an accumulator register 94 operates in conjunction with the random access memory 84 and supplies information thereto. The accumulator register 94 operates to store data used in the execution of the program and further provides information to output latches 96. In addition, the microcomputer 68 is provided with additional output latches 98 which define the "R-outputs". In this respect, the R-outputs are generally 8-bit words. The R-outputs are generally used to control the lights and perhaps any sounds, whereas the O-outputs are used to control other operating features in accordance with the flow chart previously described.

The various components heretofore described as forming part of the microcomputer receive information inputs in the manner as illustrated in FIG. 3. The software program may be embedded in the microcomputer during wafer processing by a single-level mask technique, which in essence defines the fixed read-only memory pattern.

In order to start the sequence of operation, the power to the microcomputer 68 is first initiated by turning on the off-on switch, e.g., the switch 36. The oscillator 76 will start generating the timing signals for the operation of the microcomputer 68. The program counter 72 then provides location information to enable accessing a certain location in the read-only memory 70 in which the first instruction is obtained. This instruction is then introduced and loaded into the instruction decoder 78, and this, in turn, establishes various instruction paths between the various elements of the microcomputer 68, depending upon the specific instruction itself.

The apparatus of the invention may also be constructed with discrete components as opposed to the use of the microcomputer previously described. In like manner, the apparatus may be constructed with a plurality of circuit chips, each performing one or more of the individual functions. One such arrangement of components which perform the score keeping function of the present invention is more fully illustrated in FIG. 4 of the drawings. In the embodiment of the invention is illustrated in FIG. 4, it should be understood that certain other components may form part of the microcomputer as heretofore described. For example, certain of the components as for example, the read-only memory, an arithmetic control unit, a complements generator, timing circuitry, random access memory, decoders, etc., may all form part of the microcomputer.

In the embodiment as illustrated in FIG. 4, it can be observed that the keyboard 50 and the input registers 52 have been illustrated. Located with respect to the keyboard 50 is a conventional keyboard encoder 100 which is actually interposed schematically between the keyboard 50 and the input registers 52.

The manually operable keys or switches circuit which form part of the apparatus, are connected to a keyboard encoder 100. The keyboard encoder 100 may be an individual unit connected to the keyboard 50, or it may form part of the keyboard 50 and may even be integral therewith. The keyboard encoder 100 may adopt the form of a diode matrix which generally includes a series of diodes (not shown) connected in such fashion as to generate a particular code for bit generation. For example, the keyboard encoder 100 may include a series of diodes connected in such fashion as to generate bits of binary coded decimal (BCD) code so that four bits thereof are equivalent to a decimal digit in the decimal digit system. Other forms of encoders, as for example, capacitive operated encoders, may also be used in the apparatus A of the present invention.

Actuation of any one of the keys on the keyboard 50 or the other function keys representing a decimal digit will cause a generation of four bits in the BCD code to represent that decimal digit. The diode matrix or other form of encoder 100 is well within the design purview of the skilled artisan and is therefore neither illustrated nor described in any further detail herein. However, it should be observed that any other form of code system could be utilized in the calculator of the present invention. Thus, for example, a two-out-of-six code, or otherwise, e.g., a six-bit gray code, etc., could be employed.

It can be observed that the actuation of any particular switch will identify its input or function. Moreover, each of these keyboard switches in the keyboard 14 may be provided with a so-called "key debounce" feature which prevents double entry of information. This feature is well known in the art and is therefore neither illustrated nor described in any further detail herein. Preferably, in accordance with the present invention, each key in the keyboard which operates as, and may be referred to as a "switch", is preferably a single pole, single throw (SPST) switch.

The keyboard switches which operate the encoding matrix actually may be of a very simple implementation and may include reed, mechanical switches, snap action switches, and the like. An input-sensing program may be employed and should, however, provide protection against transient noise and the double entry as previously described. In addition, the input-sensing program should provide protection against leading-edge bounce and trailing-edge bounce.

The apparatus may also be internally programmed to perform an "idle routine" which permits simultaneous scanning of the inputs until a nonquiescent condition is detected. The input is thus enabled by this scanning operation which would thereby determine if an entry distinguishes a valid key punch from a transient noise entry. In this case, if the test is positive, the program can operate with respect to the determination of the specific key which may have been pressed. Otherwise, if the test is negative, the apparatus will return to the idle condition.

After a digit or other operation function is entered, the operation is performed and the apparatus will shift to a "hold" routine. This "hold" routine performs a scan of the inputs in the keyboard matrix illustrated in FIG. 1, to determine if the keyboard remains in its quiescent condition. If a successful (negative) test results, the program returns to the idle condition.

Data may be entered via the "floating-fixed" or the "full-floating" mode of entry and is displayed as natural "floating-point numbers". It should be noted, if more than one decimal point is keyed with data entry, the decimal can be chosen in such manner that either the first or the last decimal point is effective. Generally, the entry mode of information will always be "full-floating", that is, the presentation of the digits on display will be presented with proper decimal place indication.

As indicated previously, the input register 52 may comprise a plurality of connected registers as for example, registers which receive information in either serial or parallel format. The input register or registers is designed to at least temporarily hold the introduced information which is typically scoring information. The input registers may be under the control of a timing circuit as hereinafter described to transmit the information contained therein for ultimate processing. The input register and particularly a plurality of the input registers may be designed to reorient information or otherwise initially process the information to be in a form where further processing is enabled.

The output of the input register 52 is introduced into a programmed read-only memory 102 and into a random access memory 104. The micro-programmed read-only memory 102 could be connected to a control unit (not shown) to provide input information to each control unit and which is designed to translate the code language used in the apparatus A of the present invention. The read-only memory 102 is essentially a conventional item which is commercially available and would be internally programmed to provide the desired input-output relationships defined herein. In this case, the read-only memory 102 may receive an input from a timing control circuit 106 hereinafter described.

The circuit of the present invention also includes a clock pulse generator 108 which is capable of generating clock pulses in a manner to be hereinafter described and provides these pulses as an input to the timing control circuit 106. In like manner, this timing control circuit which also functions as a timing distribution circuit, provides pulse time inputs into an arithmetic control unit 110 in the manner as illustrated in FIG. 4 of the drawings.

The clock pulse generator 108 is a conventional pulse generator which is commercially available. In one form of construction, the generator 108 and the timing circuit 106 may be combined as an integral unit. Inasmuch as the pulses or "clock frequencies" provided by the generator 108 may be divided into different frequencies by the timing circuit 106, the frequencies provided by the generator 108 are considered as master clock frequencies.

The timing control circuit 106 divides the master clock frequencies from the clock generator 108 into different phases and permits transference thereof into the various components of the circuit, in the manner as illustrated in FIG. 4. The timing control circuit 106 may comprise a series of flip-flops which divide the master clock frequencies into several divisions and phases, and in this way, it is possible to save storage time and hence to reduce the size of the random access memory 104.

By further reference to FIG. 4, it can be observed that the ROM 102 generates an output to the arithmetic logic unit 110, which, in turn, generates an output to and receives an input from the random access memory 104. The random access memory 104 could also receive an input directly from the keyboard encoder 100. Further, the timing control circuit 106 could receive an input from the read-only memory 102.

The circuit illustrated in FIG. 4 may also contain a separate control circuit (not shown) and which may be designed to translate the code language used in the apparatus of the invention. Further, a register select circuit and a flag circuit may be provided. The flag circuit would at least in part serve to partially control the random access memory 104. More specifically, a flag protect circuit could operate in conjunction with the timing control circuit 106 as well as the random access memory 104. Thus, if a particular function has been or is being performed through and under the control of the random access memory 104, this memory will be busy and a flag will prevent a second function from commencing in the random access memory 104 until the first has been completed. Thus, the flags may form a function of a buffer storage to hold information in the memory 104 and preventing new function from interfering with another function presently being performed.

The flags which may be employed in the circuit of the invention may also be used and generated in the program so as to protect information which has been introduced or generated. Thus, for example, if a user of the apparatus should enter a number of players by actuation of the rotatable multi-position switch 40, a flag will be generated to enter that number of players into a certain location in a storage in a manner as hereinafter described in more detail, so that that number cannot be removed during a play of the game for a particular game.

The arithmetic control 110 operates in conjunction with the complements generator 112 as for example, a nine complements generator. In this way, the computational functions capable of being handled by the arithmetic control unit are enhanced significantly thereby permitting the arithmetic control unit to function with nine carries and other numbers controls, or the like.

The read-only memory 102 is properly programmed through a microprogram and operates the arithmetic control unit 110 to initiate the arithmetic computations. The arithmetic control unit 110 thus could receive instructions from a separate control unit and data from the read-only memory 102 to initiate arithmetic computations on a step-by-step basis. The arithmetic control unit 110 operates in conjunction with the memory 102 in order to permit proper actuation of the random access memory 104 by generating informational signals to the memory 104 to perform the functions in accordance with the steps selected by the arithmetic control unit 110. The timing control circuit 106, which receives an output from the read-only memory 72, also provides an input to the arithmetic control unit 110, as aforesaid, in order to permit the selection of the proper steps with respect to the digits that are entered into the arithmetic control unit 110. A separate decimal point logic circuit (not shown) could be provided to shift decimal points as data is entered into the random access memory 104.

As indicated previously, the timing control circuit 106 can be comprised of a series of flip-flops and can be constructed in a variety of forms given the input-output relationships defined herein. A flag protect circuit is also well known in the art and could be comprised of a plurality of flip-flops and can also be designed in a variety of formats given the input-output relationships defined herein.

The arithmetic control unit 110 may actually include a serial BCD adder/subtractor and which normally would include add/subtract data logic. This control unit 110 also operates in conjunction with the nines compliment generator, the latter of which may also be incorporated into the circuitry of the random access memory 104.

Referring again to FIG. 4 of the drawings, it can be observed that the circuitry illustrated includes a display decode circuit comprised at least of a decoder scanner 114. Depending on the design of the random access memory 104, the display decode circuit may include the display shift registers 16, three as shown. This display decode circuit includes the decoder scanner 114 which receives an input from the random access memory 104 and timing signal inputs from the timing control circuit 106 and also generates timing signals for control of the displays.

Each display register 116 would normally be a shift register containing a number of bit positions to accommodate all of the digits to be displayed, and as distributed by the scan decoder 114. The scan decoder 114 generates individual outputs, each one of which is associated with an individual display device 60. In this case, it can be observed that three individual display devices 60 are illustrated, although in the embodiment illustrated in FIG. 1, nine display devices and nine display registers would be utilized in accordance with the present invention. The counter 108 and circuit 106 would also generate nine individual timing signals which are introduced into the decode scanner and also a multiplexer 118, forming part of the display decode circuit.

It can be observed that the input multiplexer 118 also receives a signal from the random access memory 104. In this case, and in the illustrated embodiment, the random access memory 104 can generate nine parallel outputs, and thus the line to the multiplexer 118 represents nine individual lines. However, the memory 104 could also be designed to provide a serial output, in which case the multiplexer 118 would receive a signal input line carrying the nine individual input signals. In this latter embodiment, the input multiplexer 118 would also properly receive the necessary timing signals originating from the timing control circuit 106 and the counter 108 as aforesaid.

The input multiplexer 118 generates three output signals which are introduced into decoder drivers 120 forming part of a driving circuit and which, in turn, introduce the necessary input signals into each of the display devices 60. Again, the circuit of FIG. 4 shows three displays and hence three devices are employed as shown. However, for the embodiment of the invention in FIG. 1 with nine displays, nine separate drivers 120 would be employed.

The display devices 60 could adopt the form of cold cathode display tubes. In like manner, the display devices 60 could also adopt the form of light emitting diodes. In either case, the decoder scanner 114 scans all digits introduced into the display devices 60 and the data which is introduced from the multiplexer 118 and sequentially presents energization signals to each of the display devices 60. In essence the decoder drivers 114 may serve as a power assist for the multiplexer 118 to drive the various display devices 60. Inasmuch as the multiplexer 118 receives a larger number of input lines, particularly in the case of parallel output from the random access memory 104, the multiplexer 118 actually serves as a "demultiplexer".

The decoder driving circuit may actually include both anode drivers and cathode drivers (not shown). The anode drivers would normally include a plurality of outputs, the number of which is equal to the number of display devices 60, and where each one of these outputs is connected to an anode terminal of each such display device 60. In like manner, the cathode output of the drivers 120 in the decoding driving circuit may be connected in common to the cathode terminals of each of the display devices 60. Moreover, the decoding driver circuit may include an anode register (not shown) which controls the anode drivers and a cathode register (also not shown) which also controls each of the cathode drivers.

Each time four bits, which correspond to an entered digit, enter the anode register, this register will shift four bits and a pulse will be generated to enable the display of one of the display devices 60. Four new bits representing a second decimal digit will be shifted from the random access memory 104 into the decoder scanner 114, and this second decimal digit will be displayed in the second display device 60. Consequently, it can be observed that each of the devices 60 may be simultaneously or sequentially energized and illuminated for displaying each four bits representing digits which may be introduced into the decoder scanner 114 for selective energization of a particular display device 60.

Actually, each display device 60 may preferably be sequentially energized to display the particular information and all display devices 60 are energized at a rate which is not capable of resolution by the human eye, in such manner that it appears that all the devices are simultaneously energized. Nevertheless, each individual display device 60 is sequentially energized so that only the information introduced in the display device appears at any instantaneous point of time. However, as indicated, the display device will operate so that, according to the resolution of the human eye, it appears that all display devices are energized simultaneously, much in the same manner as the raster of a cathode ray tube display which generates a display in such manner that it appears as though all points are simultaneously generated.

The apparatus of the present invention can be designed in order to provide multiple operation functions and use either floating fixed entry or full floating mode entry. One of the unique aspects of the present invention is that the apparatus is capable of automatically solving scoring calculations and provides the capability of rounding figures.

In addition to the above, the apparatus of the present invention provides leading zero suppression with protection of the results in overflow and underflow. In essence, the apparatus of the present invention permits calculation and presentation of scoring information through the implementation of a number of operational characteristics and through single-level mask programming techniques. In essence, the only limitations on the apparatus of the present invention reside around the size of the program which can be stored, the storage per se, the control timing, and the output of the decoders. Moreover, the apparatus is designed to operate with very few external components in such manner that the keyboard can be designed for use with popular diode type displays which may be decoded in order to include inter-digit blanking and leading zero suppression.

Any number of operational specifications can be programmed into the apparatus of the present invention. With respect to the invention as illustrated, the operation of the keys designated as 0 and 1, 2 . . . 9 left-shifts the display register one digit and enters the corresponding number into the least significant digit positions. Preferably, the entry mode is always full-floating so that the presentation of data on the display devices includes a proper decimal place location.

The apparatus may include a power supply 121 as schematically illustrated in FIG. 4. In this case, the power supply would normally be connected to essentially all of the major operating components for operating the same. Again, any convenient means for operating the power supply could be provided. In one of the preferred embodiments, a battery source of power may be provided in the apparatus. For example, conventional dry cell batteries could be employed. In like manner, the apparatus could be designed to operate with conventional household current, as for example, 110 AC electrical power or 110 AC power and battery power.

While timing signals with respect to the timing control circuit 106 have not been illustrated and described, it should be understood that the generation of timing signals would be conventional. Thus, the timing signals generated would be based on master clock signals as generated by the clock generator 108 and would provide for offset and timing distribution for operation of each of the components. In addition, these timing signals would provide blanking spaces, e.g., to prevent information from being displayed until the proper time, and other forms of display operating signals.

The apparatus of the invention could also be designed to include various additional optional components. For example, the apparatus could include an internal timer which is designed to maintain power to all or part of the memory components after the power switch has been turned to the "off" position. After a given time interval has elapsed, the timer would thereupon de-activate the apparatus. This timer would be used to prevent the accidental loss of data and to conserve battery power when the apparatus of the invention is not in active use. In addition, it may be desirable, depending upon the particular game, to maintain portions of power to portions of the data memory in order to prevent accidental erasing of the data for a short period of time.

The apparatus of the invention may also be provided with an external timer (hereinafter described in more detail) which is designed to provide a timing function much in the same manner as a stopwatch. For example, some games require a player to complete a move within a specified period of time. In other cases, it is desirable to record the time of an event, that is, how long a particular event took to complete, as in the case of auto racing. In this embodiment, the result of the race, that is, the amount of time, would be used directly by the apparatus to compute the results, such as average speed or other forms of information output which may be desired.

As an alternative, the apparatus of the present invention could be provided with means to permit interchangeable logic-memory modules. The purpose would be to allow one apparatus to be used for different games. Thus, each logic-memory module could be constructed at a low cost with a relatively low memory capacity. Thus, by changing the module, scoring functions for a large number of games could be performed with a single apparatus.

The input-output device, as described above, may also be adapted to have scoring information calculated by the apparatus recorded on a medium, as for example, a magnetic card. In this way, game information, e.g., particular score information, can be recorded for further use.

It should be understood that various other forms of accessories could be provided with the apparatus of the invention, as for example, carrying straps, carrying cases, and the like. Moreover, the casing or the housing for the apparatus would be normally constructed of a fairly durable material capable of withstanding abuse of the type it would normally receive in athletic game activities as described above.

FIG. 5 illustrates in schematic format a modification of the circuitry of FIG. 4 when a printing device is or may be operatively coupled to the apparatus A, whether or not the printing device is permanently affixed to the apparatus or removably attached to the apparatus. In this case, the control circuitry would include an accumulator register 122 which is connected to and receives input information from the random access memory 104. In like manner, the accumulator register 122 would be connected to the multiplexer 118 to receive information therefrom. The accumulator register 122 is also connected to a print matrix 124 which more accurately functions as a printing control circuit. The output of the print matrix 124 is connected directly to a print head 126, the latter of which actually constitutes a print-out mechanism. Any form of commercially available print-out mechanism may be provided for this purpose.

The print matrix or print control circuit could be conveniently designed given the input-output relationships described herein. Thus, any conventional print control circuit of the type normally used in hand-held calculators could be used in the apparatus of the present invention inasmuch as the print control circuit would essentially merely take the same type of information generated in a calculator and print the output results therefrom.

FIG. 6 illustrates another modified form of the invention showing a game scoring apparatus B and which is similar to the game scoring apparatus A. In this case, the game scoring apparatus B is designed for scoring information relative to the game of baseball. For this purpose, the scoring apparatus B includes a face plate 130 having at least a plurality of display devices with each capable of displaying a plurality of indicia simultaneously or substantially simultaneously.

For the typical game of baseball, a first display device 132 is available for displaying inning information, a second display device 134 for run information, a third display device 136 for hit information, a fourth display device 138 for error information, a fifth display device 140 for the number of outs, a sixth display device 142 to show the number of balls, and a seventh display device 144 for the number of strikes. In this case, it can be understood that by appropriate control mechanisms, as for example, switches associated with each of these display devices, information can be displayed for any particular player or for either team much in the same manner as previously described. In addition to the foregoing, the face plate 130 is provided with a select switch 146 having a movable element in which to shift to a player position, a team-1 or a team-2 position. In this way, by merely moving the selector switch 146 to a proper position, it is thereupon possible to generate the desired information for display in any of the aforementioned display devices.

The scoring apparatus B would similarly be provided with an off/on switch 148 similar to the off/on switch 36 on the device A as well as a keyboard 150 preferably in a numeric keyboard format. Again, the apparatus would be provided with all of the necessary function keys, as for example, a score key 152. Thus, in this case, the score key 152 would be designed to record information after the same has been properly introduced by means of the various keys in keyboard 150. Other function keys which might be necessary or desirable for this purpose (although not shown) would also be provided in the apparatus B.

The apparatus B is also provided with a timer mechanism, as for example, a timer for maintaining time counts of a particular aspect of a game event. The timer mechanism would include a timer read-out 154 having a minutes section and a seconds section, as illustrated. In addition, a timer start button 156 and a timer stop button or switch 158 would be provided. Thus, when the user of the apparatus wishes to start the timing of the function, he or she would merely actuate the timer start switch 156 and then at the appropriate time actuate the timer stop switch 158 in order to stop the timing function.

The apparatus B is also designed to work as a four-function calculator, that is, one which is capable of adding, subtracting, multiplying and dividing. In this case, data to be calculated can be introduced through actuation of the various keys in the keyboard 150. Moreover, a separate display member 160 may be provided with sufficient display segments to display a relatively large number such as would normally be found in a calculator.

The apparatus B is also provided with a plurality of function keys 162, as for example, the multiply, divide, add and subtract keys. In this way, the user can merely enter the desired information and actuate the proper function key 162 in order to enable the calculator to perform the desired function and display the resultant information. Optionally, the calculator could include other function keys, as for example, a divide accumulator, multiply accumulator, and even various memory stages for temporarily recording information for purposes of calculation. Thus, for example, the keyboard would also be provided with a record memory switch, a read memory switch and a clear memory switch. It should be understood that these are only a limited number of keys which could be provided in any type of calculator function.

The apparatus B would operate in a manner very similar to the apparatus A. In this respect, the schematic illustration of the components as illustrated in FIG. 4 will essentially be the same. Moreover, the calculator B could very well use the same type of micro-processor chip as illustrated in FIG. 3.

Thus, it can be observed that the game scoring apparatus of the present invention fulfills all of the aforementioned objectives. In addition, the game scoring apparatus may also function as a calculator, as described. Thus, the apparatus of the invention enables the scoring of individual scores for a large number of players and also permits the storing of player scores for multiple rounds or events of a game. In addition, the apparatus is capable of storing game parameters, as for example, par values for certain of the events, handicaps, and the like.

The embodiments of the apparatus also fulfill various objectives sought therefor in that they are capable of calculating the total gross scores for each player or for each team in a game. Further, each is capable of calculating the total net score for each player or team and can also be, in this regard, capable of calculating new handicap values for one or more players of the game.

As indicated above, the apparatus has many display features such that it can display the scores of each of the players or one or more teams for the game or for any event in the game. Thus, the total gross scores for the player or the team may be displayed, and total net scores for the player and the team and event scores for each player and a team may be displayed. In like manner, handicaps and various other parameters for the game can easily be displayed.

The apparatus is also uniquely designed to enable certain scoring information to be cleared, as for example, player scores and game scores without affecting game parameters that may have been entered. In addition, the apparatus could be uniquely designed in order to provide a means to detect erroneous inputs. Various programming techniques are known in the art in order to detemrine erroneous input information.

The display devices are designed so that they may be easily read, particularly in keeping with the nature of the game. Moreover, a large number of display devices are provided so that certain types of scoring information may be essentially simultaneously displayed. In this way, the user of the apparatus can conveniently compare various scores of players and various events in the game.

The individual player display devices 30 may also serve multiple functions, that is, they may serve to display more than information regarding a particular player. The apparatus would be conveniently programmed so that the display registers and, hence, the associated display device could perform these multiple functions. For example, in the case of the apparatus A, in a stroke mode, the player display devices 30 would function in the normal manner to display the score of that particular player. However, in the match mode of play, the score for a particular hole, as well as the total score, would be displayed. With two players, the first player would have the particular hole score displayed in the player-1 display device, and the total score of that player in the player-3 display device. In like manner, the second player would have the particular hole score displayed in the player-2 display device, and the total score for the second player displayed in the player-4 display device.

As indicated previously, FIG. 1 illustrates an embodiment of the game apparatus which is adapted for scoring functions in the game of golf. In this case, and for purposes of illustrating the operation of the game apparatus of the invention, the apparatus has been described in connection with obtaining scoring for a game of golf.

Before the play of the game commences, the following steps take place:

1. The on/off switch 36 is moved to the "on" position.

2. The type of scoring, e.g., match or stroke scoring, is selected by positioning the score switch 38 to the proper position.

3. The number of players may be selected, and this number entered into the apparatus by rotating the dial 40 to obtain the correct number of players as indicated on the indicator 42.

4. The 2nd key is then actuated, and then the reset key is actuated to clear the memory and initilize the apparatus.

5. A handicap for one or more players of the game may be entered by the following steps:

A. The numeric keys representing the handicap values are actuated;

B. The handicap key push button switch is actuated,

C. The appropriate player key is thereupon actuated, that is the push button key switch 32 which may also display the handicap itself in the associated display device.

6. The par, yardage and handicap rating for each hole in the golf game (event in the game) is entered in accordance with the following steps:

A. The apparatus is initialized to hole number 1 by actuating the numeric 1 key followed by the hole key;

B. The par value is entered by actuating the numeric keys representing that par value followed by actuation of a par key, C. The yardage is entered by pressing the numeric keys representing the yardage value followed by actuation of the yardage key;

D. The handicap rating is entered by pressing the numeric keys followed by the handicap rating key, E. The user of the apparatus may increment to the next hole number by again pressing the hole key. The user then continues entering par, yardage and handicap rating values for each successive hole until all data has been entered for the entire course. (As indicated previously, an automatic input device could be provided for automatically introducing this information.)

After the play commences, the players may thereupon use the apparatus in accordance with the following techniques for one mode of playing a game of golf.

1. After playing a round of golf (event), the player score for each player is entered in accordance with the following:

A. The player scores are entered by actuating the various numeric input data keys, representing an individual numeric score for a player. This is followed by actuating the appropriate player key for that player to actually enter the score. (When the score has been entered, it may be momentarily displayed on the associated player display member device 30. Actually, the player score may be displayed until another key is actuated or otherwise, it may be displayed for a relatively short period of time, e.g., 10 seconds or so in order to determine validity of correct entry.)

B. After all scores have been entered for all players of the game, the user of the apparatus can then actuate the second key followed by the hole key which will cause the scores for each player to be accumulated into the respective gross total scores. The current hole display will be incremented by one, and the current net score will be displayed in the associated player display devices 30 for each player.

C. If the scores for all players have not been entered for a particular hole or event, an error condition results, and scores for that particular hole or event cannot be calculated until all players have entered their respective scores. In this case, an error condition can be demonstrated by having the word "error" displayed on one or more of the display devices.

D. When all of the scores for the hole have been entered, the par, yardage and handicap rating entries cannot be changed.

2. In order to display the scores for a particular hole, as well as the par, yardage and handicap rating, the numeric keys are actuated representing a particular hole number, followed by actuation of the hole key. This will enable the display of the requested information, particularly on the current hole display 34. This information could be generated in sequence, or generated by each actuation of the hole key, depending upon the particular programming in the storage of the apparatus.

3. In order to display the handicap value for each player, the handicap key is actuated followed by a particular player display controlling key 32 which will permit the handicap for that player to be displayed in the player display device.

4. In order to display the total gross score for each player, the score key is actuated which is followed by the associated player display controlling key in order to permit the total gross score to be displayed in the associated player's display device.

5. In order to display the total net score for each player, the 2nd key is actuated which is followed by actuation of the score key, and which is, in turn, followed by actuation of the associated player display controlling key. This again permits the requested information to be displayed in the associated player display device.

6. An error condition which may be caused by an invalid sequence of key strokes will cause one or more of the displays to flash an "error" condition. As this occurs, the player using the device will merely actuate the reset key.

7. In order to clear player scores and leave the hole parameters in tact, the 2nd key is actuated followed by actuation of the par key. It should be understood, however, that any other combination of actuating keys in a desired sequence could be effective to clear the player scores and leave game parameters in the memory.

8. In order to clear the apparatus of all data, the 2nd key is actuated which is, in turn, followed by actuation of the reset key. Thereupon, the apparatus is capable of being used for the start of a new game.

FIG. 7 illustrates one form of storing data for enabling the game scoring apparatus A to function in the mode immediately described above. It should be understood that FIG. 7 and the following description relevant thereto, have been set forth in a schmematic format inasmuch as the data may not actually be physically stored in this form. For example, the data could be stored on a serial arrangement by address. Nevertheless, the following description relates to a typical data storage format for this mode of play in a game of golf.

| | |
|---|---|
| (R1-C1) through (R18-C1) | Hole Scores for the First Player (Strokes) |
| (R1-C2) through (R18-C2) | Hole Scores for the Second Player (Strokes) |
| (R1-C3) through (R18-C3) | A. Match Play - The won/lost indications for the first player<br>1 = 1<br>0 = loss/halved<br>B. Stroke play - the hole scores for the third player (strokes) |
| (R1-C4) through (R18-C4) | A. Match Play - the won/lost indications for the second player<br>1 = 1<br>0 - loss/halved |
| (R19-C1) | The gross score accumulator for the first player |
| (R19-C2) | The gross score accumulator for the second player |
| (R19-C3) | A. Match Play - The won/lost accumulator for the first player<br>B. Stroke Play - The gross score accumulator for the third player |
| (R19-C4) | A. Match Play - The won/lost accumulator for player two<br>B. Stroke Play - The gross score accumulator for player four |
| (R20-C1) | The handicap for player one |
| (R20-C2) | The handicap for player two |
| (R20-C3) | The handicap for player three |
| (R20-C4) | The handicap for player four |
| (R21-C1) | The current hold counter for current hole score information |
| (R21-C2) | The number of players flagged |
| (R21-C3) | The match/stroke play flag |
| (R21-C4) | The enter handicap flag |
| (R22-C1) | The display register for player one |
| (R22-C2) | The display register for player two |
| (R22-C3) | A. Match Play - The won/lost display register for player one<br>B. Stroke Play - The display register for player three |
| (R22-C4) | A. Match Play - The won/lost display register for player two<br>B. Stroke Play - The display register for player four |
| (R1-C5) through (R18-C5) | The yardage for each hole |
| (R1-C6) through (R18-C6) | The par for each hole |
| (R1-C7) through (R18-C7) | The handicap rating for each hole |
| (R19-C5) | The hole counter information |
| (R19-C6) | The input register information |
| (R19-C7) | The secondary input register infor- |

-continued

| | |
|---|---|
| | mation |
| (R20-C5) through (R20-C7) and (R21-C5) | Work registers for storage of intermediate results of calculations |
| (R21-C6) | The current hole display register information |
| (R21-C7) | The hole display register information |
| (R22-C5) | The yardage display register information |
| (R22-C6) | The par display register information |
| (R22-C7) | The handicap rating display register information |
| (R1-C1) through (R10-C1) | The handicap differentials when the scorekeeping apparatus is used to calculate a handicap. In this case, all player scores would be cleared and the handicap differential data would be entered for the handicap calculations |
| (R22-C1) | The display registers information for the calculated handicap when the scorekeeper apparatus is used in the calculate handicap mode. |

EMBODIMENT OF A PROGRAM

In the above described format, certain terms, such as accumulators, have been described which in some context may suggest physical entities. However, such terminology which has not been heretofore described as a physical item in connection with the circuit design of the invention may also possibly be generated as a function forming part of the program. Thus, the function may be generated as a software function using existing hardware as opposed to a physical entity performing such function. For example, the above described format, describes gross score accumulators, work registers, and the like. However, such accumulators and registers, etc. are merely storage locations in a memory for store of certain function information. Further, flagging of information, e.g., players flagged, is merely a programming entity as opposed to a physical entity.

A control program for use in the calculation and presentation of scoring information for the game of golf and based on the above set forth mode of operation is described in more detail hereinafter. This control program represents only one of the sequences of the logical functions that may be implemented to perform the scorekeeping enabled by the apparatus. The actual physical implementation may be varied depending upon several factors, as for example, which of the logical functions would be incorporated directly into the hardware design, as opposed to software programming thereof, the programming language used to implement the control program and the extent to which sub-routines are used to perform functions that are repeated throughout the program.

The following described control program is presented in somewhat of a modified form of "Cobal Language" since this language was deemed to be the most expedient to program commercially available microprocessors and to implement the operation of the apparatus. Further, the program is presented using the data storage format previously described in connection with FIG. 7 of the drawings and the functions therein. Certain footnotes are also provided to explain certain steps or routines or sub-routines of the program which may be designed for implementation in the program but which may not follow a true program format.

Further, in the following described program, "X" represents a row in a data storage format, e.g., as illustrated in FIG. 7 and "Y" represents a column in a data storage format, e.g., the format of FIG. 7. The terminology "move X'00' to (X, Y)" means to move zeros into the position (X, Y), much in the same manner as "move X' FF to (X, Y)" means to move "ones" into the position (X Y). Further, the program is generated in a hexidecimal system and, therefore, alpha-numeric symbology for the hexidecimal number system is used. Thus F is a hexidecimal equivalent number, such that the hexidecimal value of F is 15. FF represents all bits in the highest state, for example, possibly all "ones". Further, in the program set forth below any data entry is limited to three digits and, hence, a byte is equivalent to the number of bits for three digits.

The remaining expressions used in the program are believed to be self-explanatory in a cobal format. However, for purposes of explanation, the terminology:

| | |
|---|---|
| X = 1 through 18, by 1 | means to increment all storage positions in X = 1 through 18 by 1 (1,Y), (2,Y), (3,Y), (4,Y), (5,Y), (6,Y) . . . (18,Y) |
| Y = 5 through 7 by 1 Move X'00' to (22, Y) | means to put all zeros in (22,5) (22,6) and (22,7) of Y |
| (21, 1) = (21,1) + 1 | means to add "1" to the current contents of position (21,1) |
| Move 2 to (20,5) | means to put the numeric values of 2 in the position (20, 5) |
| [(19, 5)] | means the contents in numeric value of the storage location (19, 5) |
| [(21, 1)], [(20, 5)] | means the portion (21, 1) represents the player number and (20, 5) represents information about the event, e.g., hole area |

START

```
1.  *Clear the hole parameters storage and display areas.
    CLRPARM      For X = 1 through 18 by 1 and
                     Y = 5 through 7 by 1
                     move X'oo' to (X, Y).
    *Clear the player score areas and set the
    CURRENT HOLE counter to 1.
    CLRSCOR          For X = 1 through 22 by 1 and
                         Y = 1 through 4 by 1
                         move X'oo' to (X, Y).
                     Move X'oo' to (19,9)
                         (21, 6) and (21, 7).
                     For Y = 5 through 7 by 1
                         move X'oo' to (22, Y).
                         (21, 1) = (21, 1) + 1.
    *Set the flags for MATCH/STROKE and
    NUMBER OF PLAYERS.
    SETFLAG  Move X'oo' to (21, 3)
             If MATCH/STROKE SWITCH =
             MATCH POSITION
             move 1 to (21, 3).(1)
(1)0's if match/stroke switch is in stroke position.
1's if match/stroke switch is in match position.
                 Move X'FF' to (21, 2).
                     If NO PLAYER SWITCH = 3
                         move X'F7' to (21, 2)
                         go to CLRWRK.
                     If NO PLAYER SWITCH = 2
                         move X'F3' to (21, 2)
                         go to CLRWRK.
                     If NO PLAYER SWITCH = 1
                         move X'F1' to (21, 2).
    *Clear the secondary input register and the work areas.
    CLRWRK       Move X'oo' to (19, 7),
                     (20, 5) (20, 6) (20, 7),
                     (21, 4) and (21, 5).
    *Clear the primary input register.
    CLRINP   Move X'oo' to (19, 6).
    *Test for keyboard input.
    TESTKB       If (19, 6) > X'00'
                     go to TESTNUM(2)
                     otherwise go to TESTKB
    *Test for numeric keyboard input, if it is numeric, test for
```

-continued valid length. If length is OK, go back for more, otherwise, ERROR. If non-numeric, fall through to TESTFUNC.

```
TESTNUM     If (19, 6) numeric
              shift (19, 7) 1 digit left
              if shift truncates (19, 7),
              go to ERROR,
              otherwise if no truncate
              move (19, 6) rightmost digit
              to (19, 7) rightmost digit
              go to CLRINP.
```

(2)If true branch down to test number (TESTNUM) and if not true, keep cycling until an input is received and recognized.

*Test for type of function: NUMERIC→FUNCTION, FUNCTION, or 2ND→FUNCTION, and initiate appropriate routine. Invalid sequence result in ERROR.

```
TESTFUNC    If (19, 7) = 0
              go to TESTONE.
```

*Test the PLAYER HANDICAP ENTRY play.

```
            If (21, 4) = X'FF'
              go to SETHPLYR.
            If (19, 6) = HOLE(4)
              move (19, 7) to (19, 9)
              go to DISPHOLE.
```

*If hole number 1 has been scored, bypass the hole parameter entry functions.

```
            If (21, 2) > 1
              go to SETPLYR.
```

*Hole parameter entry functions.

```
            If (19, 6) = PAR
              Move (19, 7) to ([(19, 5)], 6)
              go to DISPHOLE.
            If (19, 6) = YARDS
              move (19, 7) to ([(19, 5)], 5)
              go to DISPHOLE.
            If (19, 6) = HNDCP RTG
              move (19, 7) to ([(18, 5)], 7)
              go to DISPHOLE.
```

(3)There are only three valid input forms, e.g., (i) a numeric followed by a function, (ii) a function and (iii) a second followed by a function.

(4)The function code generated by the hole key.

```
            If (19, 6) = HNDCP
              move X'FF' to (21, 4)
              go to CLRINP.
```

*Test for functions that operate without numeric input.

```
TESTONE     If (20, 5) = X'FF'
              GO TO TEST 2ND.
            If (19, 6) = HOLE
              (19, 5) = (19, 5) + 1
              go to DISPHOLE.
            If (19, 6) = SCORE
              GO TO GSCORE.
            If (19, 6) = HNDCP
              go to DISPHDCP.
            If (19, 6) = RESET
              go to CLRWRK.
            If (19, 6) = PRINT
              GO TO PRINT.
            If (19, 6) = 2 ND
              move X'FF' to (20, 5)
              go to CLRINP.
          Go to ERROR.
```

*Set the handicap valve for the appropriate player.

```
SETHPLYR    If (19, 6) = PLAYER 1
              move 1 TO (20 ,5)
              go to MOVHND.
            If (19, 6) = PLAYER 2
              move 2 to (20, 5)
              go to MOVHND.
            If (19, 6) = PLAYER 3
              move 3 to (20, 5)
              go to MOVHND.
            If (19, 6) = PLAYER 4
              move 4 to (20, 5)
              go to MOVHND.
          Go to ERROR.
```

*Move the input handicap value to the appropriate player's handicap storage location. Turn off the ENTER HANDICAP flag and branch to the routine that displays the handicap values.

```
MOVHND      Move (19, 7) to (20, [(20, 5)]).
            Move X'oo' to (21, 4).
            Go to DISPHDCP.
```

-continued

*Test for which player the score is being entered and set the ENTER SCORE bit for that player to ON.(5)

```
SETPLYR     If (19, 6) = PLAYER 1
              move 1 to (20, 5)
              set (20, 6) bit 7 to ON
              go to MOVSCORE.
            If (19, 6) = PLAYER 2
              move 2 to (20, 5)
              set (20, 6) bit 6 to ON
              go to MOVSCORE.
            If (19, 6) = PLAYER 3
              move 3 to (20, 5)
              set (20, 6) bit 5 to ON
              go to MOVSCOR.
            If (19, 6) = PLAYER 4
              move 4 to (20, 5)
              go to MOVSCOR.
          Go to ENTHAND.
```

(5)The SETPLYR routine enables assurance that scores for all players in each event (holes) have been entered before scores for the next hole or event can be entered.

*Move the player score to the appropriate data storage area.

```
MOVSCOR     Move (19, 7) to ([(21, 1)], [(20, 5)]).
```

*If the CURRENT HOLE counter is the same as the HOLE being displayed, display the new score for the player. Otherwise, display the HOLE parameters for the CURRENT HOLE, and the new player score.

```
            If (21, 1) = (19, 5)
              move (19, 7) to (22, [(20, 5)])
              go to CLRWRK
          Otherwise
              move (21, 1) to (19, 5)
              go to DISPHOLE.
```

*Enter and store the data used for calculating a new handicap value.

```
ENTHAND     If (19, 6) not = CALC HNDCP
              go to ERROR.
            (20, 5) = (20, 5) + 1
            If (20, 5) > 10
              go to ERROR.
            Move (19, 7) to ([(20, 5)], 1)
            Move X'00' to (19, 7)
            Go to CLRINP.
```

*Display the hole parameters and player scores for the hole.

```
DISPHOLE    For Y = 1 thru 7 by 1
              move ([(19, 5)], Y) to (22, Y).
            Move (19, 5) to (21, 7).
            Go to CLRWRK.
```

*Display the handicap for each player.

```
DISPHDCP    For Y = 1 thru 4 by 1
            move (20, Y) to (22, Y).
            Go to CLRWRK.
```

*Display the handicap for each player.

```
DISPHDCP    For Y = 1 thru 4 by 1
              move (20, Y) to (22, Y),
            Go to CLRWRK.
```

*Display the current value of the gross score for each player.

```
GSCORE      For Y = 1 thru 4 by 1
              move (19, Y) to (22, Y).
          Go to CLRWRK.
```

*Move the storage contents to the print output buffer.

```
PRINT       For X = 1 thru 7 by 1
              Y = 1 thru 21 by 1
              move (X, Y) to (22, 7)
          Go to CLRWRK.
```

*Test for 2ND key functions.

```
TEST2ND     If (19, 6) = RESET
              go to CLRPARM.
            If (19, 6) = PAR
              go to CLRSCOR.
            If (19, 6) = HOLE
              go to ENTSCOR.
            If (19, 6) = SCORE
              go to NSCORE.
            If (19, 6) = CALC HNDCP
              go to CALCHND.
          Go to ERROR.
```

*Test if scores for all players have been entered. If OK, accumulate gross scores and increment CURRENT HOLE counter. If not OK, ERROR.

```
ENTSCOR     If (21, 2) not = (20, 6)(6)
```

-continued

```
                go to ERROR.
              For Y = 1 through number of
   PLAY-
   ERS by 1(7)
                (19, Y) = (19, Y) + ([(21, 1)], Y).
   *Test for MATCH/STROKE
              If (21, 3) = 1
                go to ENTMSCR.
   *Increment CURRENT HOLE and display new net scores.
                (21, 1) = (21, 1) + 1.
                Move (21, 1) to (21, 6).
                Go to NSCORE.
   *Match score routine - determine the net score for each player,
   determine the winner of the hole, accumulate the won/lost count
   for each player, increment and display the CURRENT HOLE
   count and display the new net scores.
   ENTMSCR      For Y = 1 through 2 by 1
                  (20, Y) / 18 = (20, 5)(8)
                  RESULT, (20,6)(9) REM.
                  (20, 6) / ([21, 6],7) = (20, 7)(10)
                  ([(21, 6)],Y) - (20, 5) - (20, 7) =
                  ([(21, 6)], [Y + X]).
                If ([(21, 6)],3) = ([(21, 6)], 4)
                  move X'oo' to ([(21,6)],3),
                  ([(21,6)],4).
(6)If location (21, 2) does not have contents equal to that of
location (20, 6).
(7)The number of players for Y = 1 is incremented by (1) if (21, 2)
is equal to (20, 6); and this is performed 'n' times for 'n' players,
e.g., four times for four players.
(8)Result of (20, Y) / 18 stored in (20, 5).
(9)Remainder of (20, Y) / 18 stored in (20, 6).
(10)The dividend of the field (20, 6) divided by ([21, 6]7) is
placed in location (20, 7).
(11)Using the player -3 display device and related members to
contain and display player -1 information.
                If ([(21, 6)],3) < ([(21, 6)],4)
                  move 1 to ([(21, 6)], 3)
                  move 0 to ([(21, 6)],4)
              Otherwise
                  move 0 to ([(21, 6)],3)
                  move 1 to ([(21, 6)], 4).
                For Y = 3 thru 4 by 1
                  (19, Y) = (19, Y) + ([(21,5)],Y).
                  (21, 1) = (21, 1) + 1.
                Move (21, 1) to (21, 6).
              Go to NSCORE.
   *Display the net score for each player.
   NSCORE       If (21, 3) = 1
                  go to MNSCORE
                For Y = 1 thru NO PLAYERS by 1
                  (20, 5) = (19, Y) - (20, Y)
                  move (20, 5) to (22, Y).
              Go to CLRWRK.
   *Display the net strokes for players 1 and 2, and the won/lost
   count for players 1 and 2.
   MNSCORE      For Y = 1 thru 2 by 1
                  (20, 9) = (19, Y) - (20, Y)
                  move (20, 5) to (22, Y).
                For Y = 3 thru 4 by 1
                  move (19, Y) to (22, Y).
              Go to CLRWRK.
   *Calculate the player handicap from the previously entered
   data, display new value.
   CALCHND        If (20, 9) > 10 or
                    (20, 9) = 0
                    Go to ERROR.
                Move 1 to (20, 6).
   STRT LOOP        (20, 7) = (20, 7) + ([(20,6)],1).
                  If (20, 6) = (20, 9)
                    go to END LOOP.
                    (20, 6) = (20, 6) + 1.
                    Go to STRT LOOP.
   END LOOP         (21, 5) = (20, 7) / (20, 5).
                    (21, 5) = (21, 5) × 89 / 100.
                Move (21, 5) to (22, 1).
                    Go to CLRSCOR.
   *Error routine.
   ERROR        Activate hardware function to flash the
                display and reject all input except the
                RESET key.
```

END

Thus, there has been illustrated and described a unique and novel electronic game scoring apparatus which is capable of calculating and presenting scoring information about a game and one or more players of the game, and which, therefore, fulfills all of the objects and advantages sought therefor. It should be understood that many changes, modifications, variations, and other uses and applications of the game scoring apparatus will become apparent to those skilled in the art after considering this specification and the accompanying drawings. Therefore, any and all such changes, modifications, variations, and other uses and applications which do not depart from the nature and spirit of the invention are deemed to be covered by the invention which is limited only by the following claims.

Having thus described my invention, what I desire to claim and secure by Letters Patent is:

1. An electronically operable athletic game scoring apparatus for scoring information on an athletic game in which two or more players compete and events of the game and for the competing players of the athletic game, said apparatus comprising:

(a) a relatively small and hand-held portable housing, (b) a plurality of manually actuable input switches on said housing for introducing scoring information relevant to an athletic game and to several events of said game, said input switches also capable of introducing information relevant to each of the players of the game and the events of the game, (c) at least one first manually actuable display controlling switch on said housing for permitting display of scoring information relevant to each of such players of the game, (d) at least one second manually actuable display control switch on said housing for permitting display of total scoring information of said game or of scoring information of one or more of the events in said game, (e) at least one third manually actuable display control switch on said housing for permitting display of scoring information relevant to a scoring parameter of the game or the events of the game, and (f) a display means on said housing for displaying scoring information of the game or events upon actuation of the first display control switch and for displaying scoring information of any or all of the players upon actuation of the second display control switch.

2. The scoring apparatus of claim 1 further characterized in that a plurality of individual display means are located on said housing for separably and simultaneously displaying scoring information, one of said display means displaying scoring information about the game and events of the game, and a second of the display means displaying scoring information about the players of the game.

3. The scoring apparatus of claim 2 further characterized in that said first display control switch permits display of scoring information relevant to said game and events of the game and is associated with the first display means for operation of same, and said second display control switch permits display of scoring information relevant to the players and is associated with a second of the display means for operation of same.

4. The scoring apparatus of claim 3 further characterized in that a third display control switch permits display of total scoring information for said game and a fourth display control switch permits display of scoring information of an event in said game.

5. The scoring apparatus of claim 1 further characterized in that manually actuable switch means is on said housing for introducing handicap information with respect to one or more players of said game.

6. The scoring apparatus of claim 1 further characterized in that said apparatus comprises means for printing scoring information on a permanent record.

7. The scoring apparatus of claim 1 further characterized in that said apparatus comprises means for introducing information relevant to maintaining scores from an external source.

8. The scoring apparatus of claim 1 further characterized in that said game scoring apparatus is adapted to score information on the game of golf and is capable of providing hole information, par information, yard score information and handicap information for the game and for each player of the game.

9. The scoring apparatus of claim 1 further characterized in that said apparatus comprises microprocessor means operatively connected to said input means and said display controlling switch, said microprocessor means generating scoring information relevant to each of the events of the game and total scoring information for all of the events thus far completed during the course of the game even though the game is not completed, and for the entire game when the game is completed, said microprocessor means further generating scoring information relevant to each of the players of the game for the events of the game and for the total game.

10. The scoring apparatus of claim 1 further characterized in that said apparatus comprises a microprocessor capable of generating scoring information about a parameter of the game and scoring information about the game or an event of the game and scoring information about at least one or more players of the game for substantially simultaneous display.

11. The scoring apparatus of claim 10 further characterized in that:

(a) said display means is a first display means which is operatively connected to said microprocessor for displaying information about a parameter of the game relative to a score, said apparatus also comprises:

(b) a second display means operatively connected to said microprocessor for displaying scoring information about the game or an event of the game substantially simultaneously with the display of a parameter of the game on the first display means, and (c) a third display means operatively connected to said microprocessor for displaying scoring information about at least one or more players of the game substantially simultaneously with the display of a parameter on the first display means and the display of the scoring information on the second display means.

12. The scoring apparatus of claim 11 further characterized in that said apparatus comprises a fourth display means operatively connected to said microprocessor for displaying scoring information about another player of the game substantially simultaneously with the display of scoring information about one or more players of the game on the third display means.

13. The scoring apparatus of claim 11 further characterized in that said apparatus comprises:

(a) a first display control switch associated with the first display means for controlling the display of information therein, (b) a second display control switch associated with the second display means for controlling the display of information therein, and (c) a third display control switch associated with the third display means for controlling the display of information therein.

14. An electronically operable athletic game scoring apparatus for scoring information on an athletic game in which two or more players compete and events of the game and for the competing players of the athletic game, (a) a housing, (b) manually actuable keyboard input means on said housing for introducing information relevant to scoring of an athletic game, and to several events of said game, said input means also capable of introducing information relevant to each of the players of the game and events of the game, (c) input storage means for receiving and temporarily storing the introduced information, (d) data storage means operatively connected to said input storage means for receiving introduced information, (e) electronic microprocessor means operatively connected to said data storage means for processing the introduced information in accordance with a program therein, said microprocessor means generating scoring inforamtion relevant to each of the events of the game and total scoring information for all of the events thus far completed during the course of the game even though the game is not completed, and for the entire game when the game is completed, said microprocessor means further generating scoring inforamtion relevant to each of the players of said game for the events in the game and for the total game, (f) switch means on said housing for selecting the type of scoring inforamtion to be generated, and for permitting display of scoring information relevant to each of the players of the game or the events of the game and for permitting display of scoring information of any or all of the players, (g) display means on said housing for displaying the generated scoring information.

15. The scoring apparatus of claim 14 further characterized in that said apparatus comprises:

(a) at least one first manually actuable display controlling on said housing for permitting display of scoring information relevant to an event of said game, (b) at least one second manually actuable display controlling switch on said housing for permitting display of total scoring information of said game, and (c) at least one third manually actuable display controlling switch on said housing for permitting display of scoring information relevant to each of the players of the game.

16. The scoring apparatus of claim 15 further characterized in that said microprocessor is capable of generating scoring information about a parameter of the game as well as the scoring information about the game or an event of the game and scoring information about at least one or more players of the game, and such information is capable of being substantially simultaneously displayed.

17. The scoring apparatus of claim 16 further characterized in that said display means is:

(a) a first display means which is operatively connected to said microprocessor for displaying information about a parameter of the game relating to a score, said apparatus also comprising (b) a second display means operatively connected to said microprocessor for displaying scoring information about the game or an event of the game substantially simultaneously with the display of a parameter of the game on the first display means, and (c) a third display means operatively connected to said microprocessor for displaying scoring information about at least one or more players of the game substantially simultaneously with the display of a parameter on the first display means and the display of the scoring information on the second display means.

18. The scoring apparatus of claim 16 further characterized in that said apparatus comprises a fourth display means operatively connected to said microprocessor for displaying scoring information about another player of the game substantially simultaneously with the display of scoring information about one or more players of the game on the third display means.

19. The scoring apparatus of claim 17 further characterized in that said apparatus comprises:

(a) a first display control switch associated with the first display means for controlling the display of information therein, (b) a second display control switch associated with the second display means for controlling the display of information therein, and (c) a third display control switch associated with the third display means for controlling the display of information therein.

20. The scoring apparatus of claim 14 further characterized in that a plurality of individual display means are located on said housing for separately and simultaneously displaying scoring information.

21. The scoring apparatus of claim 14 further characterized in that a first display means permits display of scoring information relevant to said game and a second display means permits display of scoring information relevant to one or more players.

22. The scoring apparatus of claim 21 further characterized in that a third display means permits display of total scoring information for said game and a fourth display means permits display of scoring information of an event in said game.

23. The scoring apparatus of claim 14 further characterized in that manually actuable switch means is on said housing for introducing handicap information with respect to one or more players of said game.

24. The scoring apparatus of claim 14 further characterized in that said data storage means comprises at least a read only memory and said microprocessor means comprises a random access memory means.

25. The scoring apparatus of claim 24 further characterized in that said microprocessor means comprises an arithmetic control unit for performing calculations.

26. The scoring apparatus of claim 25 further characterized in that said apparatus comprises a keyboard to enable functioning as a multi-function calculator.

27. An electronically operable game scoring apparatus for scoring information on an athletic game in which two or more players compete and events of the game and for competing players of the athletic game, said apparatus comprising:

(a) a relatively small and hand-held portable housing, (b) a plurality of manually actuable input switches on said housing for introducing scoring information relevant to an athletic game and to several events of said game, said input switches also capable of introducing information relevant to each of the players of the game and events of the game, (c) at least one first manually actuable display controlling switch on said housing for permitting display of scoring information relating to said game, (d) at least one second manually actuable display controlling switch on said housing for permitting display of scoring information relating to each of the players of the game or the events of the game, (e) a first display means on said housing for displaying scoring information relating to said game and to events of said game upon actuation of at least one of said display controlling switches, and (f) a second display means on said housing for individually displaying scoring information relating to each of said players upon actuation of another one of said display controlling switches.

28. The scoring apparatus of claim 27 further characterized in that said apparatus is provided with at least one third manually actuable display controlling switch on said housing for also permitting display of scoring information relating to one or more of such players.

29. The scoring apparatus of claim 28 is further characterized in that the first display controlling switch controls the first display means and the second display controlling switch controls the second display means.

30. The scoring apparatus of claim 27 further characterized in that a plurality of additional individual display means are located on said housing for separately and simultaneously displaying scoring information relating at least to one or more additional players.

31. The scoring apparatus of claim 30 further characterized in that a third display controlling switch permits display of total scoring information for said game and a fourth display controlling switch permits display of scoring information of an event in said game.

32. The scoring apparatus of claim 27 further characterized in that a manually actuable switch means is on said housing for introducing handicap information with respect to one or more players of said game.

33. An electronically operable game scoring apparatus of claim 27 comprising:

(a) input storage means for receiving and temporarily storing the introduced information, (b) data storage means operatively connected to said input storage means for receiving introduced information, and (c) electronic microprocessor means operatively connected to said data storage means for processing the introduced information in accordance with a program introduced therein, said microprocessor means generating scoring information relevant to said game and scoring information relevant to one or more players of said game.

34. The scoring apparatus of claim 27 further characterized in that said apparatus comprises means for printing scoring information on a permanent record.

35. The scoring apparatus of claim 27 further characterized in that said apparatus comprises means for introducing information relevant to maintaining scores from an external source.

36. The scoring apparatus of claim 27 further characterized in that said apparatus comprises microprocessor means operatively connected to said input means and said display controlling switch, said microprocessor means generating scoring information relevant to each of the events of the game and total scoring information for all of the events thus far completed during the course of the game even though the game is not completed, and for the entire game when the game is completed, said microprocessor means further generating scoring information relevant to each of the players of the game for the events of the game and for the total game.

37. The scoring apparatus of claim 27 further characterized in that said apparatus comprises a microprocessor which is capable of generating scoring information about a parameter of the game as well as scoring information about the game or an event of the game and scoring information about at least one or more players of the game for substantially simultaneous display.

38. The scoring apparatus of claim 37 further characterized in that said first display means is operatively connected to said microprocessor for displaying information relating to the game and scoring information relating to events of the game, said second display means is operatively connected to said microprocessor for displaying scoring information about the players of the game or events of the game substantially simultaneously with the display on the first display means, said apparatus comprises a third display means operatively connected to said microprocessor for displaying scoring information about a parameter of the game relating to scoring substantially simultaneously with the display on the first display means and the display on the second display means.

39. The scoring apparatus of claim 38 further characterized in that said apparatus comprises a fourth display means operatively connected to said microprocessor for displaying scoring information about another player of the game substantially simultaneously with the display of scoring information about one or more players of the game on the third display means.

40. The scoring apparatus of claim 38 further characterized in that said apparatus comprises:

(a) a first display control switch associated with the first display means for controlling the display of information therein, (b) a second display control switch associated with the second display means for controlling the display of information therein, and (c) a third display control switch associated with the third display means for controlling the display of information therein.

41. An electronic device for calculating and presenting scoring information for an athletic game in which two or more players compete and events of the games and for competing players of the athletic game, said device comprising:

(a) a small and portable hand-held housing, (b) first manually operable input means on said housing for introducing scoring data relating to an athletic game and to several events of said game, said input switches also capable of introducing information relevant to each of the players of the game and events of the game, (c) second manually operable input means on said housing for introducing instructional commands related to determination of scoring information, (d) first programmed memory means operatively connected to said first and second input means to receive data and instructional commands, (e) arithmetic control means operatively connected to said first memory means to perform mathematical computations on the data pursuant to the instructional commands to thereby determine score information, (f) second random access memory means operatively connected to said arithmetic control means and input means, said random access memory means storing and processing data and operating in conjunction with said arithmetic control means, (g) at least one manually actuable display control switch on said housing for permitting display of scoring information relevant to the game and events of the game and to each of the players of the game, (h) and display means operatively connected to said second memory means for displaying computational results of the mathematical computations on the data.

42. The electronic device of claim 41 further characterized in that clocking means is provided for generating timing signals for controlling the computations on a clock time basis.

43. The electronic device of claim 41 further characterized in that said calculator comprises decimal point logic means operatively connected to said second memory means for controlling decimal point location in the computational results thus displayed.

44. The electronic device of claim 41 further characterized in that said display means operates in conjunction with decoding means operatively connected to an output of said second memory means, multiplexing means operatively connected to said second memory means, and a plurality of individual display devices receiving inputs from said decoding means and said multiplexing means.

45. An electronically operable athletic game scoring apparatus for scoring information on an athletic game in which two or more players compete and events of the game and for the competing players of the athletic game, said apparatus comprises:

(a) a relatively small and hand-held portable housing, (b) a plurality of manually actuable input switches on said housing for introducing scoring information relevant to an athletic game and to several events of said game, said input switches also capable of introducing information relevant to each of the players of the game and events of the game.

(c) microprocessor means operatively connected to said input switches for generating scoring information relevant to each of the events of the game and total scoring information for all of the events thus far completed during the course of the game even though the game is not completed, and for the entire game when the game is completed, said microprocessor means further generating scoring information relevant to each of the players of the game for the events of the game and for the total game, said microprocessor also capable of generating scoring information about a parameter of the game and with the scoring information about at least one or more players of the game for being generated for substantially simultaneous display, (d) a first display means operatively connected to said microprocessor for displaying information about a parameter of the game relating to a score, (e) a second display means operatively connected to said microprocessor for displaying scoring information about the game or an event of the game substantially simultaneously with the display of a parameter of the game on the first display means, (f) a third display means operatively connected to said microprocessor for displaying scoring information about at least one of the players of the game substantially simultaneously with the display of a parameter on the first display means and the display of the scoring information on the second display means, (g) a fourth display means operatively connected to said microprocessor for displaying scoring information about another player of the game substantially simultaneously with the display of scoring information about the one player of the game on the third display means, (h) at least one first manually actuable display controlling switch on said housing for permitting display of scoring information relevant to said game and said events, and for permitting display of scoring information relevant to each of the players of the game, and (i) at least one second manually actuable display control switch on said housing for permitting display of total scoring information of said game or of scoring information of one or more of the events in said game.

46. The scoring apparatus of claim 45 further characterized in that said first display control switch is associated with the first display means for controlling the display of information therein, said second display control switch associated with the second display means for controlling the display of information therein, said apparatus comprising third and fourth display control switches associated with the third and fourth display means respectively for controlling the display of information therein.

47. The scoring apparatus of claim 45 further characterized in that manually actuable switch means is on said housing for introducing handicap information with respect to one or more players of said game.

48. The scoring apparatus of claim 45 further characterized in that said apparatus comprising means for printing scoring information on a permanent record.

49. The scoring apparatus of claim 45 further characterized in that said apparatus comprises means for introducing information relevant to maintaining scores from an external source.

50. The scoring apparatus of claim 45 further characterized in that said game scoring apparatus is adapted to score information on the game of golf and is capable of providing hole information, par information, yard score information and handicap information for the game and for each player of the game.

51. An electronically operable game scoring apparatus for scoring information on the game of golf, said apparatus comprising:

(a) a relatively small and hand-held portable housing, (b) a plurality of manually actuable input switches on said housing for introducing scoring information relevant to the event and one or more players of the game and the events of the game of golf, (c) at least one manually actuable display controlling switch on said housing for permitting display of scoring information relevant to said game, or for permitting display of scoring information relevant to one or more of such players, (d) at least one manually actuable display control switch in said housing for permitting display of total scoring information of said game or of scoring information of an event in said game, and for permitting display of hole information, par information, yard score information and handicap information for the game and for each player of the game, and (e) a display means on said housing for displaying such scoring information upon actuation of at least one display switch.

52. An electronically operable game scoring apparatus for scoring information of the game of golf, said apparatus comprising:

(a) a housing, (b) manually actuable keyboard input means on said housing for introducing information relevant to scoring of the game of golf, (c) input storage means for receiving and temporarily storing the introduced information, (d) data storage means operatively connects to said input storage means for receiving introduced information, (e) electronic microprocessor means operatively connected to said data storage means for processing the introduced information in accordance with a program therein, said microprocessor means generating scoring information relevant to said game and scoring information relevant to each of the players of said game and total scoring information and scoring information of an event in the game and yard score information, (f) switch means on said housing for selecting the type of scoring information to be generated, and (g) display means on said housing for displaying the generated scoring information, and for displaying hole information, par information and handicap information for the game and for each player of the game.

53. An electronically operable game scoring apparatus for scoring information on the game of golf, said apparatus comprising:

(a) a relatively small and hand-held portable housing, (b) a plurality of manually actuable input switches on said housing for introducing scoring information relevant to the game and one or more players of the game, (c) means operatively connected to said input switches for calculating scoring information relevant to the game and one or more players of the game and providing hole information, par information, yard score information and handicap information for the game and for each player of the game, (d) at least one first manually actuable display controlling switch on said housing for permitting display of scoring information relating to said game or to said players, (e) a first display means on said housing for displaying such scoring information relating to said game upon actuation of at least one said display controlling switches, and (f) a second display means on said housing for displaying such scoring information relating to one or more of said players upon actuation of another one of said display controlling switches.

54. An electronic device for calculating and presenting scoring information on the game of golf, said device comprising:

(a) a small and portable hand-held housing, (b) first manually operable input means on said housing for introducing scoring data relating to the game of golf or one or more players of the game, (c) second manually operable input means on said housing for introducing instructional commands related to determination of scoring information, (d) first programmed memory means operatively connected to said first and second input means to receive data and instructional commands, (e) arithmetic control means operatively connected to said first memory means to perform mathematical computations on the data pursuant to the instructional commands to thereby determine score information, (f) second random access memory means operatively connected to said arithmetic control means and input means, said random access memory means storing and processing data and operating in conjunction with said arithmetic control means, (g) and display means operatively connected to said second memory means for displaying computational results of the mathematical computations on the data and displaying hole information, par information, yard score information and handicap information for the game of golf and for each player of the game.

* * * * *